US008299443B1

(12) United States Patent
Shvartsburg et al.

(10) Patent No.: US 8,299,443 B1
(45) Date of Patent: Oct. 30, 2012

(54) MICROCHIP AND WEDGE ION FUNNELS AND PLANAR ION BEAM ANALYZERS USING SAME

(75) Inventors: Alexandre A. Shvartsburg, Richland, WA (US); Gordon A. Anderson, Benton City, WA (US); Richard D. Smith, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 13/087,100

(22) Filed: Apr. 14, 2011

(51) Int. Cl.
*H01J 49/42* (2006.01)
*H01J 49/04* (2006.01)

(52) U.S. Cl. ..... 250/396 R; 250/293; 250/292

(58) Field of Classification Search ..... 250/281, 250/282, 283, 286, 288, 289, 290, 291, 292, 250/293, 396 R, 397
See application file for complete search history.

(56) References Cited

U.S. PATENT DOCUMENTS

| | | | | |
|---|---|---|---|---|
| 6,107,628 | A * | 8/2000 | Smith et al. | 250/292 |
| 6,583,408 | B2 * | 6/2003 | Smith et al. | 250/288 |
| 6,730,904 | B1 | 5/2004 | Wells | |
| 6,979,816 | B2 | 12/2005 | Tang et al. | |
| 7,491,930 | B2 * | 2/2009 | Shvartsburg et al. | 250/287 |
| 8,080,787 | B2 * | 12/2011 | Rather et al. | 250/290 |
| 2007/0284524 | A1 * | 12/2007 | Franzen | 250/292 |
| 2008/0017794 | A1 | 1/2008 | Verbeck | |
| 2008/0156978 | A1 * | 7/2008 | Shvartsburg et al. | 250/282 |
| 2009/0026361 | A1 | 1/2009 | Syms et al. | |
| 2009/0039282 | A1 * | 2/2009 | Haase et al. | 250/423 R |
| 2009/0294644 | A1 | 12/2009 | Belov | |
| 2009/0294662 | A1 | 12/2009 | Belov et al. | |
| 2009/0321655 | A1 | 12/2009 | Makarov et al. | |
| 2010/0090102 | A1 * | 4/2010 | Rather et al. | 250/283 |
| 2011/0062322 | A1 * | 3/2011 | Franzen | 250/282 |

FOREIGN PATENT DOCUMENTS

EP 1704578 B1 4/2011

(Continued)

OTHER PUBLICATIONS

Hoaglund-Hyzer, C. S., et al., Coupling Ion Mobility Separations, Collisional Activation Techniques, and Multiple Stages of MS for Analysis of Complex Peptide Mixtures, Anal. Chem. 2022, 74, 992-1006.

(Continued)

*Primary Examiner* — Bernard E Souw
(74) *Attorney, Agent, or Firm* — James D. Matheson

(57) ABSTRACT

Electrodynamic ion funnels confine, guide, or focus ions in gases using the Dehmelt potential of oscillatory electric field. New funnel designs operating at or close to atmospheric gas pressure are described. Effective ion focusing at such pressures is enabled by fields of extreme amplitude and frequency, allowed in microscopic gaps that have much higher electrical breakdown thresholds in any gas than the macroscopic gaps of present funnels. The new microscopic-gap funnels are useful for interfacing atmospheric-pressure ionization sources to mass spectrometry (MS) and ion mobility separation (IMS) stages including differential IMS or FAIMS, as well as IMS and MS stages in various configurations. In particular, "wedge" funnels comprising two planar surfaces positioned at an angle and wedge funnel traps derived therefrom can compress ion beams in one dimension, producing narrow belt-shaped beams and laterally elongated cuboid packets. This beam profile reduces the ion density and thus space-charge effects, mitigating the adverse impact thereof on the resolving power, measurement accuracy, and dynamic range of MS and IMS analyzers, while a greater overlap with coplanar light or particle beams can benefit spectroscopic methods.

32 Claims, 17 Drawing Sheets

FOREIGN PATENT DOCUMENTS

| | | | |
|---|---|---|---|
| WO | 2005067000 | A2 | 7/2005 |
| WO | 2009066087 | A2 | 5/2009 |

OTHER PUBLICATIONS

Kelly, R. T., et al., Array of Chemically Etched Fused-Silica Emitters for Improving the Sensitivity and Quantitation of Electrospray Ionization Mass Spectrometry, Anal. Chem. 2007, 79, 4192-4198.
Shvartsburg, A. A., et al., High-Resolution Field Asymmetric Waveform Ion Mobility Spectrometry Using New Planar Geometry Analyzers, Anal. Chem. 2006, 78, 3706-3714.
Barnett, D. A., et al., Characterization of Temperature-Controlled FAIMS System, J. Am. Soc. Mass Spectrom., 2009, 20, 1768.
Tang, K., et al, High-Sensitivity Ion Mobility Spectrometry/Mass Spectrometry Using Electrodynamic Ion Funnel Interfaces, Anal. Chem., 2005, 77, 3330-3339.
Koeniger, S. L., et al., an IMS-IMS Analogue of MS-MS, Anal. Chem. 2006, 78, 4161-4174.
Belov, M. E., et al., Multiplexed Ion Mobility Spectrometry-Orthoganal Time-of-Flight Mass Spectrometry, Anal. Chem. 2007, 79, 2451-2462.
Kelly, R. T., et al., The Ion Funnel: Theory, Implementations, and Applications, Mass Spectrometry Reviews, 2010, 29, 294-312.
Shaffer, S. A., et al., Characterization of an Improved Electrodynamic Ion Funnel Interface for Electrospray Ionization Mass Spectrometry, Anal. Chem. 1999, 71, 2957-2964.
Ibrahim, Y. M., et al., Improving Mass Spectrometer Sensitivity Using a High-Pressure Electrodynamic Ion Funnel Interface, J. Am. Soc. Mass Spectrom. 2006, 17, 1299.
Kim, T. M., et al., A Multicapillary Inlet Jet Disruption Electrodynamic Ion Funnel Interface for Improved Sensitivity Using Atmospheric Pressure Ion Sources, Anal. Chem. 2001, 73. 4162-4170.
Kelly, R. T., et al., Capillary-Based Multi Nanoelectrospray Emitters: Improvements in Ion Transmission Efficiency and Implementation with Capillary Reversed-Phase LC-ESI-MS, Anal. Chem. 2008, 80, 143-149.
Page, J. S., et al., Subambient Pressure Ionization with Nanoelectrospray Source and Interface for Improved Sensitivity in Mass Spectrometry, Anal. Chem. 2008, 80, 1800-1805.
Tolmachev, A. V., et al., Coulombic Effects in Ion Mobility Spectrometry, Anal. Chem. 2009, 81, 4778-4787.
Shvartsburg, A. A., et al., High-Resolution Differential Ion Mobility Separations Using Helium-Rich Gases, Anal. Chem. 2010, 82, 2456-2462.
Shvartsburg, A. A., et al., Ultrafast Differential Ion Mobility Spectrometry at Extreme Electric Fields in Multichannel Microchips. Anal. Chem. 2009, 81, 6489-6495.
Vonderach, M., et al., Combining Ion Mobility Spectrometry, Mass Spectrometry, and Photoelectron Spectroscopy in a High-Transmission Instrument, Anal. Chem. 2011, 83, 1108-1115.
Mabrouki, R. B., et al., Improving FAIMS Sensitivity Using a Planar Geometry with Slit Interfaces, American Society for Mass Spectrometry, 2009, 20, 1768-1774.
International Search Report/Written Opinion for International Application No. PCT/US2012/021338, International Filing Date Jan. 13, 2012, Date of Mailing Jul. 24, 2012.

* cited by examiner

MICROCHIP AND WEDGE ION FUNNELS AND PLANAR ION BEAM ANALYZERS USING SAME

FEDERALLY-SPONSORED RESEARCH AND DEVELOPMENT

This invention was made with Government support under Contract DE-AC06-76RLO1830 awarded by the U.S. Department of Energy. The Government has certain rights in the invention.

FIELD OF THE INVENTION

The invention relates to systems and methods for guidance and focusing of ions, particularly in the context of mass spectrometry (MS) and ion mobility spectrometry (IMS). Specifically, the invention discloses an electrodynamic ion funnel of new design and construction technology, and novel MS and IMS operational modes that it enables.

BACKGROUND OF THE INVENTION

Modern biomedical and environmental research and applications depend on detailed and comprehensive characterization of complex samples. The demands of specificity, sensitivity, and speed have made mass spectrometry (MS) the prevailing platform for such analyses. Most real samples are sufficiently challenging to necessitate one or more separation steps prior to MS. These separations are typically performed in the condensed phase, using liquid chromatography (LC) or capillary electrophoresis (CE). Nowadays, those methods are increasingly replaced or supplemented by separations in gases relying on ion mobility spectrometry (IMS), including field asymmetric waveform IMS (FANS).

MS can analyze ions only. For large and fragile molecules including proteins, peptides, DNA strands of significant length, and most metabolites and other biomolecules, electrospray ionization (ESI) and its derivatives such as desorption ESI or laser ablation ESI are commonly employed. The ESI efficiency is maximized at high (near-atmospheric) gas pressure and drops with decreasing pressure to zero in vacuum, hence ESI sources are normally operated at ambient pressure. Some ion sources, for example matrix-assisted laser desorption ionization (MALDI), can perform in vacuum, but are often employed at ambient pressure for speed and convenience. Use of such atmospheric pressure ionization (API) sources inevitably creates the problem of effective ion transfer into the MS vacuum through a necessarily narrow orifice that is typically much smaller than the produced ion swarm. The same issue arises when coupling IMS or FAIMS stages among themselves or to MS, where ion beams or packets that spread (because of diffusion and Coulomb repulsion) during separation must be introduced into an MS or another IMS stage via a narrow aperture.

In API/MS systems, the MS inlet has typically been fashioned as a curtain plate/orifice assembly (FIG. 1*a*) or a heated capillary (FIG. 1*b*). These differ in how the solvated ions generated by ESI are desolvated: by gas counter-flow while being pushed forward by an electric field (FIG. 1*a*) or heated gas flow (FIG. 1*b*). In either case, the conductance limit between the atmosphere and MS vacuum is much narrower than the incoming ion plume, leading to major ion losses even with a single ESI emitter. Losses are larger yet with emitter arrays that provide more effective and uniform ionization at lower liquid flow per emitter, but deliver ions over a wider area (FIG. 1*c*). The typical pressure in the first MS chamber after either interface is several Torr, the maximum for effective evacuation by standard vacuum pumps. Thus the gas coming from atmosphere supersonically expands, greatly broadening the ion beams beyond the aperture of the skimmer leading to the next MS chamber, which causes further losses. Thus ~1% and often much less of ions produced by ESI are transmitted to the high-vacuum MS regions, limiting the MS sensitivity and dynamic range. Similarly, in drift-tube (DT) IMS, ion packets expand orthogonally to the tube axis during separation, and <1% of ions enter the following MS stage via a pinhole at the tube terminus (FIG. 1*d*). In conjunction with losses at the tube front and low DTIMS duty cycle, that has reduced sensitivity so severely as to preclude commercialization of DTIMS/MS systems and their use in most practical analyses. For FAIMS devices, the analytical gap geometry is crucial, Units with curved gaps feature an inhomogeneous electric field that focuses ions to the median. With hemispherical caps, those units produce tight beams that can pass through narrow MS inlets with few losses. This focusing also constrains the FANS resolving power, obstructing many applications. Planar FAIMS units have a homogeneous field that effects no focusing and thus may provide exceptional resolution, but ions freely diffuse, broadening the beam in the plane of the gap cross-section. In transverse-cylindrical FAILS units, ions are focused to the gap median but also freely diffuse in the lateral direction. Extracting such broadened beams through standard inlets to an MS (or reduced-pressure IMS) stage is associated with huge ion losses that limit the utility of high-resolution FAILS (FIG. 1*e*). Slit-aperture MS inlets that better match the rectangular cross-section of ion beams exiting planar FAIMS devices provide some improvement, but large losses remain.

The need to focus ion beams or packets at substantial gas pressure for transmission into lower-pressure instrument stages through a necessarily tight aperture is broadly encountered in MS and hyphenated MS, and is often critical for successful analyses. This need has previously been addressed using electrodynamic ion funnels, at the simplest comprising stacks of electrodes separated by insulator gaps (including air gaps) of given gap width (g) with circular apertures that narrow along the stack (FIG. 2*a*). An RF voltage of some frequency (w) and peak amplitude (U) applied to adjacent electrodes with opposite phases produces an oscillatory electric field near the funnel avails. The peak field intensity (A) rapidly drops when distancing from the walls, and the resulting Dehmelt potential repels ions toward the funnel axis, preventing their loss on the electrodes. A ladder of DC voltages is typically co-applied to electrodes to establish a potential gradient along the axis, which pulls confined ions through the funnel while compressing them to the diameter of the smallest exit aperture (d). In practice, the RF voltage is loaded onto the electrodes using two capacitor chains, one connected to the even-numbered electrodes and the other to the odd-numbered electrodes, and DC voltages are produced using a resistor chain. A pressure drop behind the funnel produces the vacuum suction and thus axial gas flow that accelerates toward the exit (FIG. 2*a*). This gas flow aids the DC field to pull ions along the funnel, and, depending on the funnel length, conical angle, and other design and operational parameters, may suffice to pull a large fraction of ions through the funnel even with no DC field. If the apertures narrow enough in terms of the electrode spacing (s), the RF field also creates axial traps that capture ions and impede their motion through the funnel. This effect rapidly grows as d decreases below 2 s, limiting the minimum practical final beam diameter to ~1.5 s-2 s. The entrance opening is not physically restricted and should be large enough to collect most or all of the incoming ions. A 1-in. diameter has sufficed for ions expanding from as al inlet at the front end of MS or IMS stages. The funnels at DTIMS termini may need a larger opening, depending on the tube length, drift voltage, and gas temperature that control the ion expansion in the tube, and a 2-in. diameter has been used with longer tubes.

The base funnel implementation transmits incoming ions without significant delay, which is suitable for coupling to MS and has been broadly adopted to interface ESI, conventional IMS, and FAIMS units to various MS systems. However, DTIMS accepts ions in pulses and thus strongly benefits from ion accumulation before the starting gate. This need has been addressed using "hourglass" ion funnel traps (IFT) that comprise sections where apertures broaden along the direction of ion travel (FIG. 2*b*), providing the ion storage volume at a reduced pressure equal, or close, to that in the following chamber. on packets injected into the tube may be refocused (e.g., for better IMS resolving power) employing a "double hourglass" IFT that comprises another section of narrowing apertures (FIG. 2*c*). Such funnels are equally appropriate with DTIMS in the multiplexed mode and can work with any stage requiring pulsed ion introduction.

Non-accumulating funnels can transmit close to 100% of ions, at least at not-too-high flux where Coulomb repulsion is limited. "Hourglass" IFTs also have high ion utilization efficiency until the charge capacity is reached. For API/MS interfaces, the transmission through the inlet is roughly determined by the ratio of its cross-section (c) at the conductance limit to the area of incoming plum. However, at a given pumping capacity on the funnel, the pressure inside (P) is determined by the gas load that is proportional to c. Thus, the maximum feasible c depends on the highest usable P value. The performance and practicality of DTIMS also improves at higher pressure: in particular, the tube can be shortened without resolution loss. Again, the maximum pressure in DTIMS with front and/or back funnel interfaces is set by their limitations. The FAIMS resolving power also benefits from higher gas pressure (other factors being equal). Hence maximizing the operating pressure of ion funnels, ideally to 1 atm, is a key technological goal in the MS and IMS/MS field.

Physics of the ion focusing in Dehmelt potential requires a certain ratio of w to the ion-molecule collision frequency that depends on the ion species but is always proportional to pressure, hence w should be scaled with P. At a given gas temperature, effective focusing further requires a minimum potential depth that, by theory, scales as $A^2/w^2$. Therefore, raising the operating pressure also necessitates a proportional increase of A. An ion funnel is a capacitive bad and the power needed to drive it is proportional to electrical capacitance (c). Hence the realizable w and A values are limited by c, which thus should be minimized. First-generation funnels (with g=0.5 mm) developed in 1997-2002 had large capacitances that, with practical power supplies, limited w to ~400 kHz and U to ~40 V. These parameters allowed P up to ~5 Torr depending on the species, which was close to the values in first stages of MS instruments with skimmer interfaces. Thus API/MS inlets were restricted to c~0.3 $mm^2$, resulting in large ion losses at the inlet faces and materially constraining the capabilities and utility of IMS/MS platforms. These devices still transmit ions an order of magnitude better than prior skimmer interfaces, and are now adopted in research and commercial MS systems as well as IMS/MS and FAIMS/MS platforms.

In $2^{nd}$-generation funnels developed since 2004, the capacitance was reduced 4-fold via a change of geometry and machining/assembly methods that minimized electrode surfaces and replaced the insulation between electrodes by air gaps with the lowest possible dielectric constant of 1. That has enabled a proportionally greater w~2 MHz and U~200 V, permitting similar increases of P to ~30 Torr and c to ~2 $mm^2$ and higher, depending on the vacuum pumps and inlet capillary length. A single capillary with that large c would not desolvate ions completely and uniformly enough, but multiple (e.g., six) capillaries of regular diameter summing to c may be parallelized to reach high total flow while keeping the established desolvation regime. Large ion capture area and current capacity of such multicapillary inlets are of particular value with ESI emitter arrays. A higher pressure in the funnel similarly elevates that in the following MS chamber, increasing which by 5 times is generally untenable. Hence a high-pressure funnel was coupled to MS using an original (low-pressure) funnel. Such multicapillary inlet/tandem ion funnel interfaces (FIG. 2*d*) have improved the sensitivity of API/MS by ~5 times compared to "standard" funnels, in proportion to the increase of P and gas intake via the inlet. However, losses are still large and further increase of the operating pressure and gas intake is desired. However, w and A could not be raised further within the existing paradigm of funnel assembly from individually machined macroscopic electrodes.

The field intensity in a gas is limited by the electrical breakdown threshold, which depends on the gas identity and pressure. While the rf voltages and thus A values in existing funnels can be raised using more powerful power supplies, a breakdown near the waveform peak would occur. Hence an approach to increase the funnel pressure by raising w and A must include the means to avoid breakdown.

An approach alternative to raising the funnel pressure is ESI in a sealed chamber at sub-ambient pressure. Such "SPIN" sources have been shown to work at a pressure as low as ~30 Torr, allowing operation inside high-pressure funnels. While this virtually eliminates ion losses, the lower efficiency of ESI at 30 Torr offsets that, and the final ion yield is close to that using atmospheric-pressure ESI with multicapillary inlet/tandem ion funnel interface. Even if future ESI sources could hypothetically overcome that problem, the need for better ion focusing in IMS/MS and FAIMS/MS interlaces would remain and so would the need to increase the operating pressure of ion funnels, ideally to 1 atm.

The force of mutual Coulomb repulsion scales as the ion density squared and thus rapidly grows for stronger ion currents. The resulting space-charge expansions limit the resolving power of MS [in particular, orthogonal time-of-flight (o-ToF) MS] or IMS systems and their sensitivity, as ions exceeding the analyzer charge capacity are eliminated. Large ion flux gains provided by funnel interlaces known in the art already cause notable peak broadening in DTIMS, which would worsen as funnels at higher pressures deliver even greater ion currents. Hence reducing the space-charge effects is important for MS and IMS technology development and becomes increasingly topical as improvements of ion sources and front interfaces produce more intense ion beams.

SUMMARY OF THE INVENTION

The invention includes electrodynamic ion funnels (the devices that focus ions in gases using RF electric fields) operating at much higher pressures than previous ion funnels, and planar ion beam analyzers involving same. To enable the high-pressure operation, these devices are built with much smaller features using the MEMS platform and technology and, in a particular implementation, having the "wedge" geometry. The device includes a plurality of electrodes with gaps therebetween, which carry an oscillatory electric field created by alternating voltages to produce a Dehmelt potential. The field intensity required for effective focusing at high gas pressure is precluded in macroscopic gaps by electrical breakdown in the gas, but is permitted in the instant invention by microscopic gaps that have a higher breakdown threshold.

In some embodiments, the device operates at ambient atmospheric pressure. In other embodiments, the pressure ranges from 50 Torr to about 1 atm. In yet other embodiments, the pressure ranges from about 1 atm to 5 atm. In various embodiments, the thickness of electrodes and width of inter-electrode gaps ranges from 10 μm to 200 μm and particularly from 10 μm to 75 μm. In some embodiments, the electrode thickness ranges from ⅓ to 3 times the width of gaps between them and particularly equals that width. In various embodiments, the RF field frequency ranges from 10 MHz to 150 MHz and particularly from 25 MHz to 60 MHz.

In various embodiments, the electrodes are plates with internal apertures of any geometry arranged in a stack, where neighboring plates carry opposite phases of an alternating voltage. Ions are conveyed through the apertures sequentially across the stack while the Dehmelt force repels ions inside from the aperture circumference. In some embodiments, ions are propelled along the stack by a time-independent longitudinal electric field derived from a ladder of fixed voltages applied to the plates in addition to the RF voltage. In other embodiments, ions are propelled along the stack by a gas flow resulting from vacuum suction into a following instrument stage at a lower pressure including, but not limited to, a mass spectrometer, an ion mobility spectrometer, a photoelectron spectrometer, a photodissociation spectrometer, and combinations of these stages. In some embodiments, the apertures have essentially the same geometry and cross-sectional area, defining an ion-guiding tunnel. In other embodiments, the apertures have homologous shapes and cross-sectional areas that decrease along the stack, defining a funnel that focuses ion beams entering the stack through an entrance aperture into tighter beams exiting through a smaller terminal aperture. In other embodiments, the apertures have homologous shapes and cross-sectional areas that increase in preselected segments and decrease in other segments along the stack, defining hourglass ion funnels, wherein regions having wider apertures for ion storage are separated by regions of narrower apertures for ion focusing.

In some embodiments, the electrodes are patterned on, or attached to, a preselected surface, forming a periodic grating such that the Dehmelt force repels ions from the surface. In particular, the electrodes may display a surface of metal or other electrically conductive material deposed on an insulating substrate body. In some embodiments, ions are moved along the preselected surface by a longitudinal electric field derived from a ladder of fixed voltages applied to the electrodes in superposition with RF voltages.

In one embodiment, at least two of the preselected surfaces are disposed at an angle forming a wedge funnel with an open slit at the apex. Ion beams entering the open base of the wedge are compressed in one dimension, forming a narrower belt-shaped beam exiting through said slit. Ions are propelled through the wedge by a longitudinal electric field derived from a ladder of fixed voltages applied to the elements on the preselected surfaces, a gas flow resulting from vacuum suction into a following instrument stage, or a combination thereof.

In some embodiments, the device receives ions from a linear or elongated rectangular array of elementary sources such as an electrospray (ESI) emitter array or a plate for matrix-assisted laser desorption ionization (MALDI). In other embodiments, the device is disposed at or after the IMS analyzer terminus to compress ion packets exiting therefrom into the rectangular parallelepiped geometry for injection into another instrument stage. In still other embodiments, the device is disposed at or after the terminus of a differential mobility analyzer (DMA) or FAIMS analyzer of planar or transverse-cylindrical gap geometry to compress the belt-shaped ion beams exiting from these stages for injection into another stage. In different embodiments, the stage following the device is an MS stage, an IMS stage, a photoelectron spectrometer, a photodissociation spectrometer, or a combination thereof. In some embodiments, the belt-shaped ion beam exiting a wedge funnel is refocused into a circular or other cross-sectional shape using a following ion funnel at a gas pressure lower than that inside the wedge. In other embodiments, the belt-shaped ion beam is introduced into a subsequent IMS stage in a continuous or pulsed mode, and separated or filtered therein while retaining a rectangular cross section. Here, the IMS stage may be DTIMS, traveling-wave IMS, DMA, or FAIMS, or a combination thereof. In other embodiments, the belt-shaped ion beam is extracted from an IMS stage with compression that retains its rectangular r cross section for introduction into another analyzer including IMS stages, photoelectron spectrometers, photodissociation spectrometers, and combinations thereof. In other embodiments, the belt-shaped beam is injected into a subsequent MS stage, in a continuous or pulsed mode, and analyzed therein while retaining a rectangular cross section. In particular, the MS stage may be a ToF mass spectrometer, with the lateral span of the belt-shaped beam orthogonal to both the directions of ion velocity in MS analysis and ion injection into the ToF instrument. In one embodiment, the belt-shaped beam is injected into an IMS stage, separated therein, and extracted and injected into an MS stage while retaining the rectangular cross section such that the whole IMS/MS separation is performed on a planar ion beam.

DETAILED DESCRIPTION

The invention provides effective RF ion focusing across the range of ion mass-to-charge ratios most relevant to proteomics and metabolomics (~300-3,000) at P>0.1 atm. In particular, the pressure may range from 0.3 to 1 atm and even exceed 1 atm, Even P=0.3 atm allows ESI (in the form of SPIN sources) and IMS/MS to perform virtually as well as at ambient pressure.

As detailed herein, extensive characterization of $2^{nd}$-generation ion funnels has proven the theory that the maximum operating pressure scales with w and A. The underlying physics has no pressure limit and must equally apply up to P=1 atm and beyond. Then effective ion focusing at P=1 atm (or ~25 times the present value of P=30 Torr) would require w ~50 MHz and, in the current funnel geometry, U=5 kV or A=100 kV/cm, Reaching those values would necessitate augmenting the electrical power output by $25^4$=390,625 times, an impossible proposition from either the power consumption or heat release viewpoints. Also, the breakdown voltage for a 0.5-mm gap at P=1 atm is ~2 kV in $N_7$ or air and much lower in He gas and He/$N_2$ mixtures with 50-75% He that are critical to high-resolution FAIMS and many IMS applications in structural biology and other areas. Hence a hypothetical funnel with g=0.5 mm and U=5 kV would instantly break down even in $N_2$ or air, let alone He-containing gases.

Figure 1A:
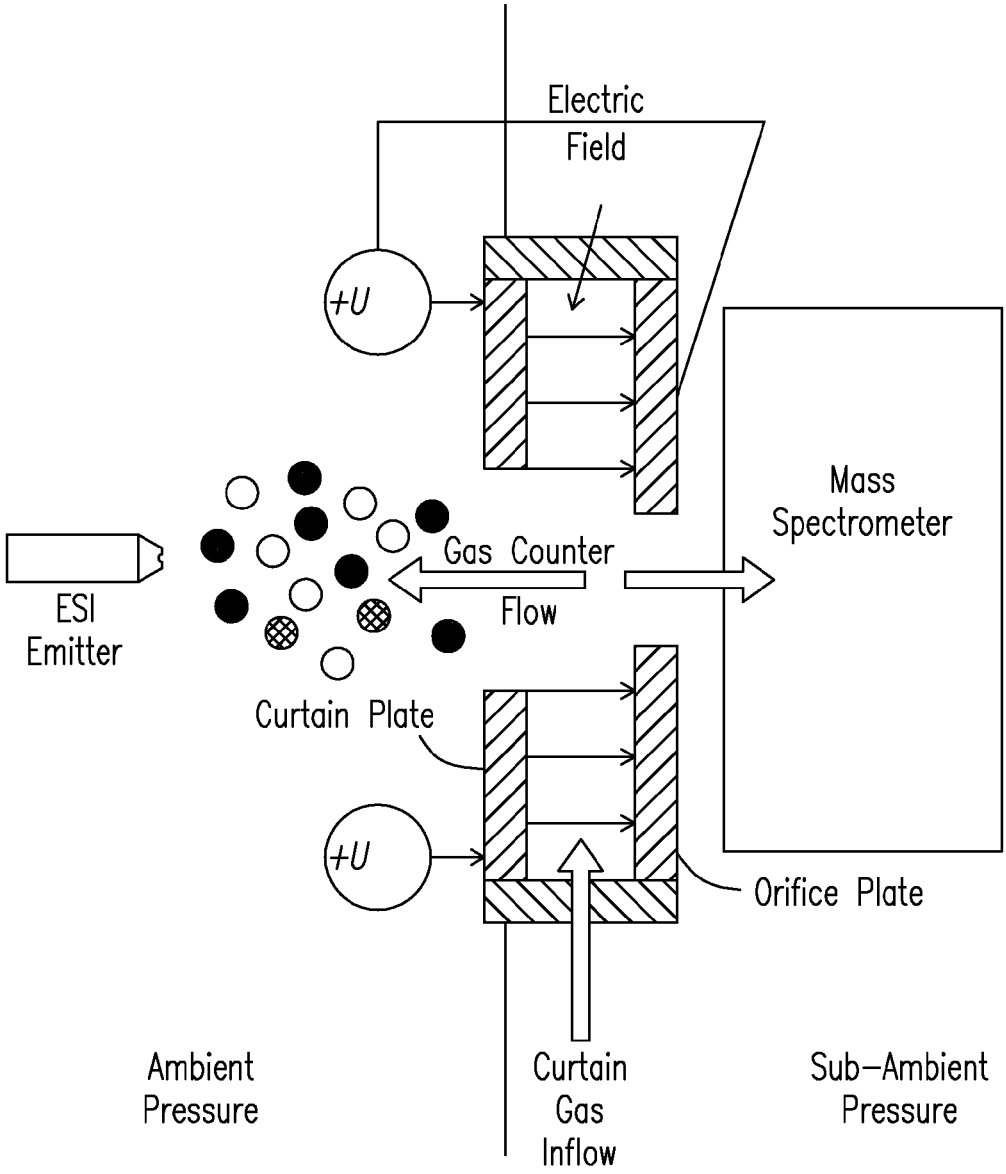
Fig. 1a (Prior Art)
FIGS. 1*a*-1*e* (prior art) show conventional designs for desolvation of ions produced by ESI.
Figure 1B:
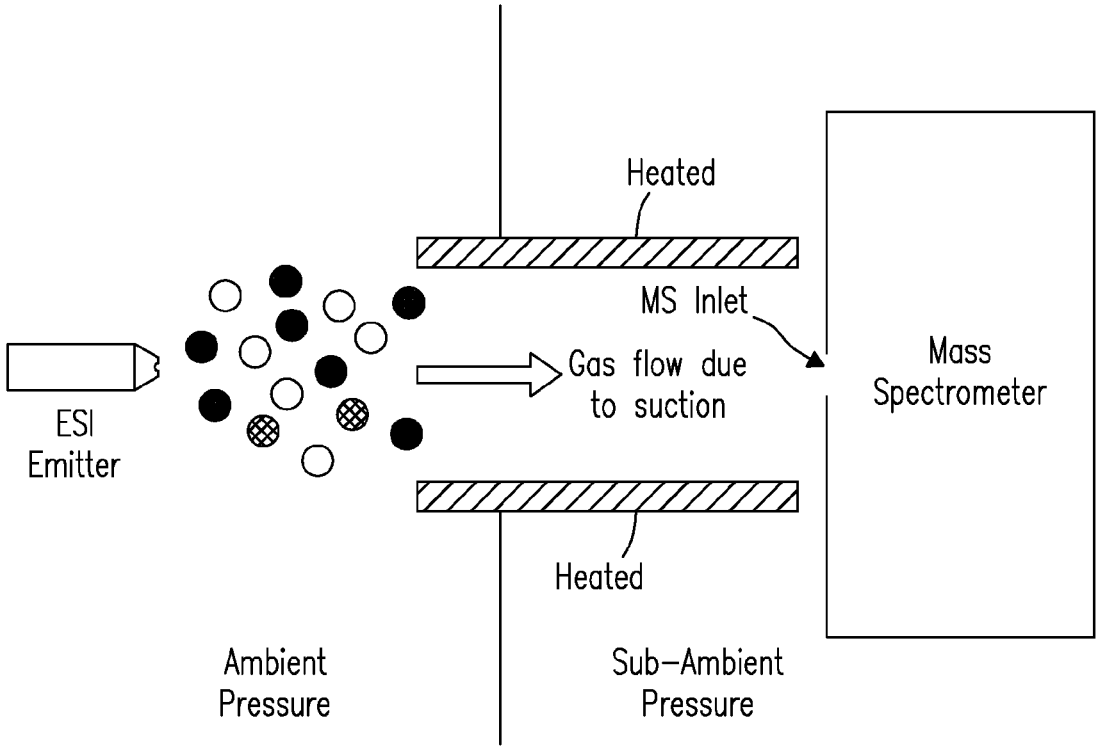
Fig. 1b (Prior Art)
Figure 1C:
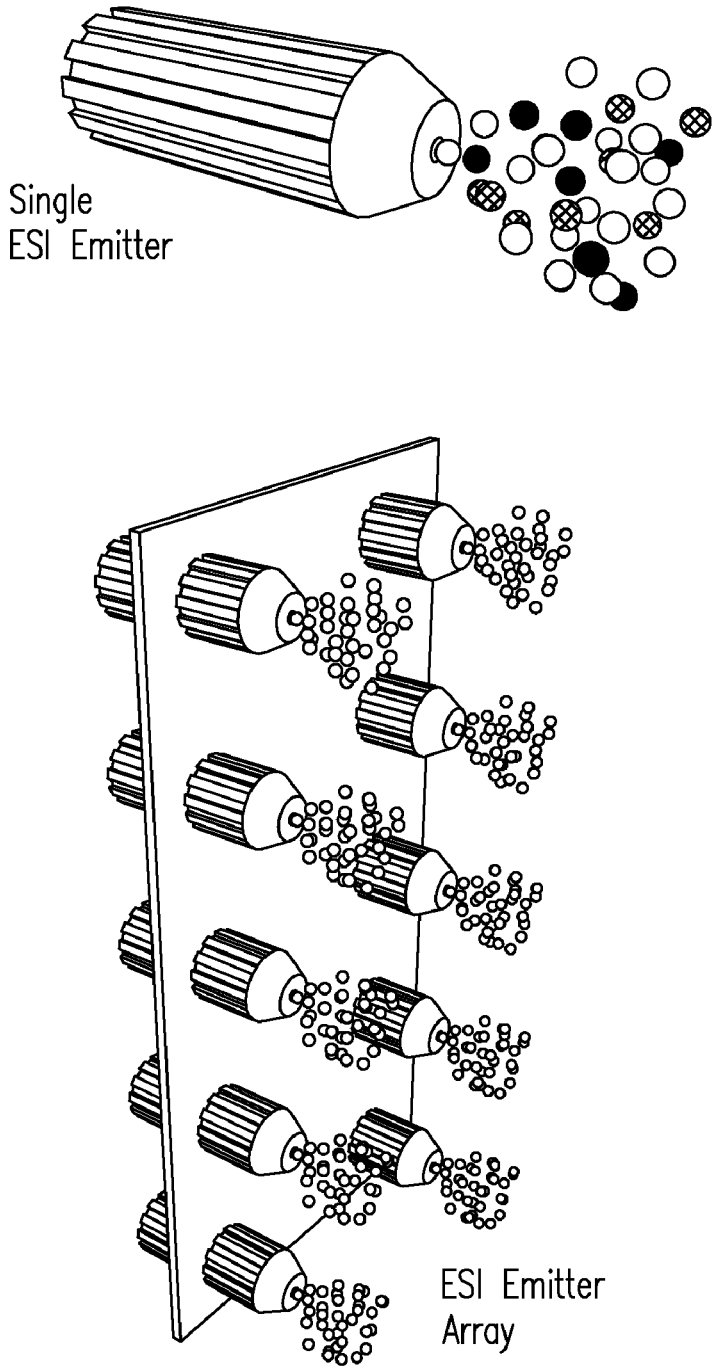
Fig. 1c (Prior Art)
Figure 1D:
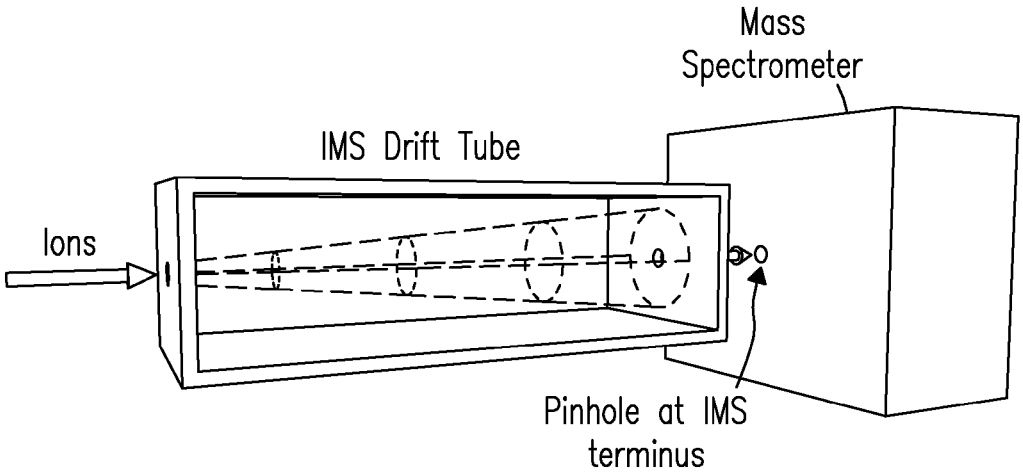
Fig. 1d (Prior Art)
Figure 1E:
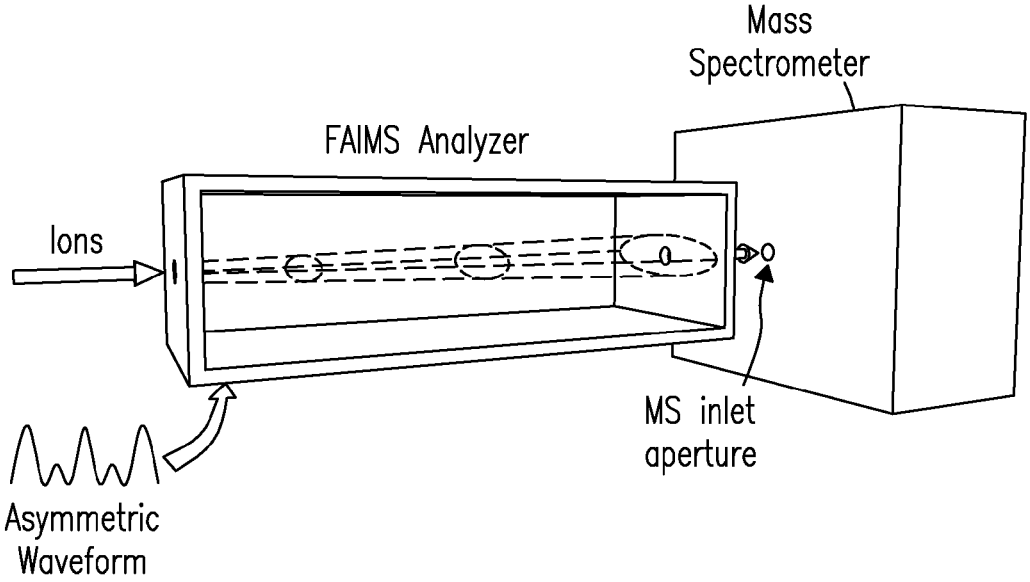
Fig. 1e (Prior Art)
Figure 2A:
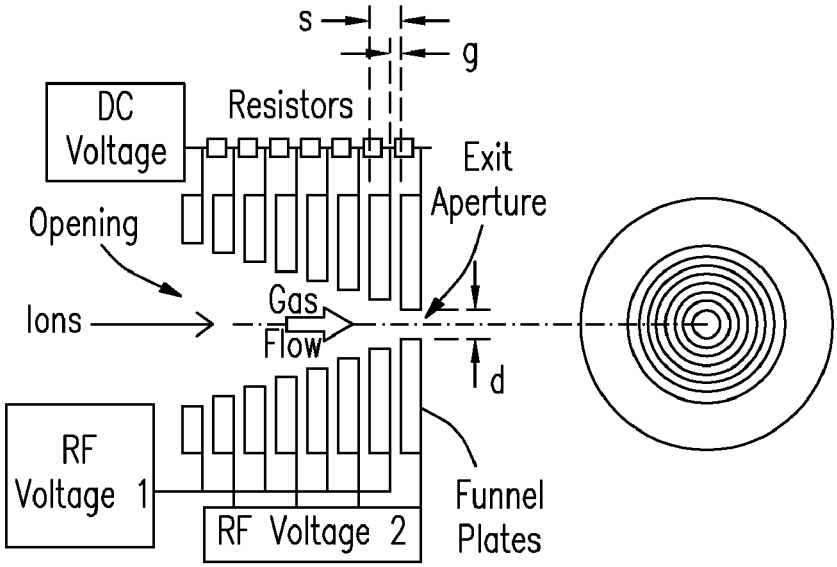
Fig. 2a (Prior Art)
FIGS. 2*a*-2*d* (prior art) show different conical ion funnel designs.
Figure 2B:
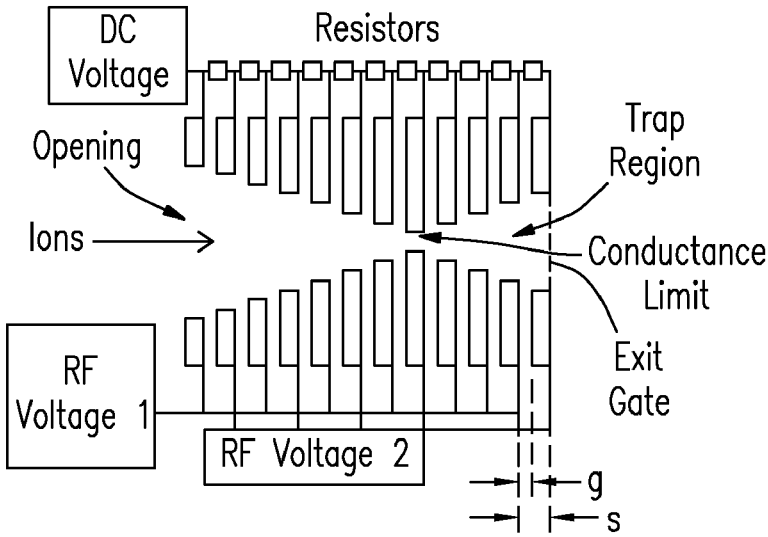
Fig. 2b (Prior Art)
Figure 2C:
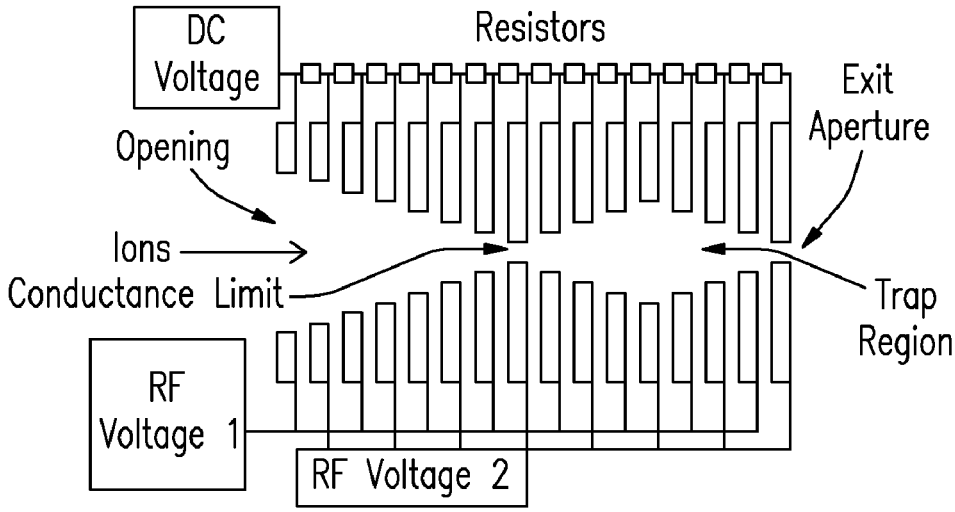
Fig. 2c (Prior Art)
Figure 2D:
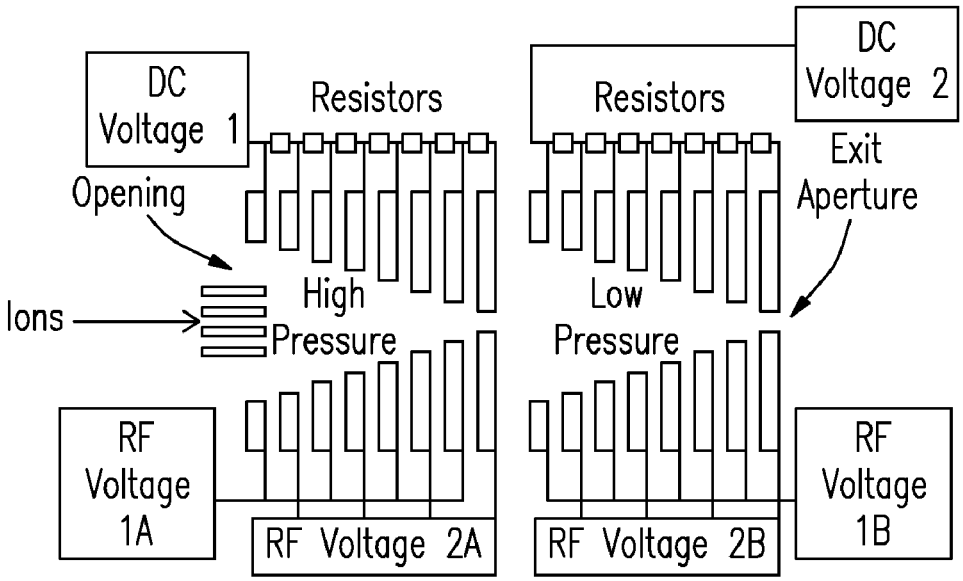
Fig. 2d (Prior Art)
Figure 3A:
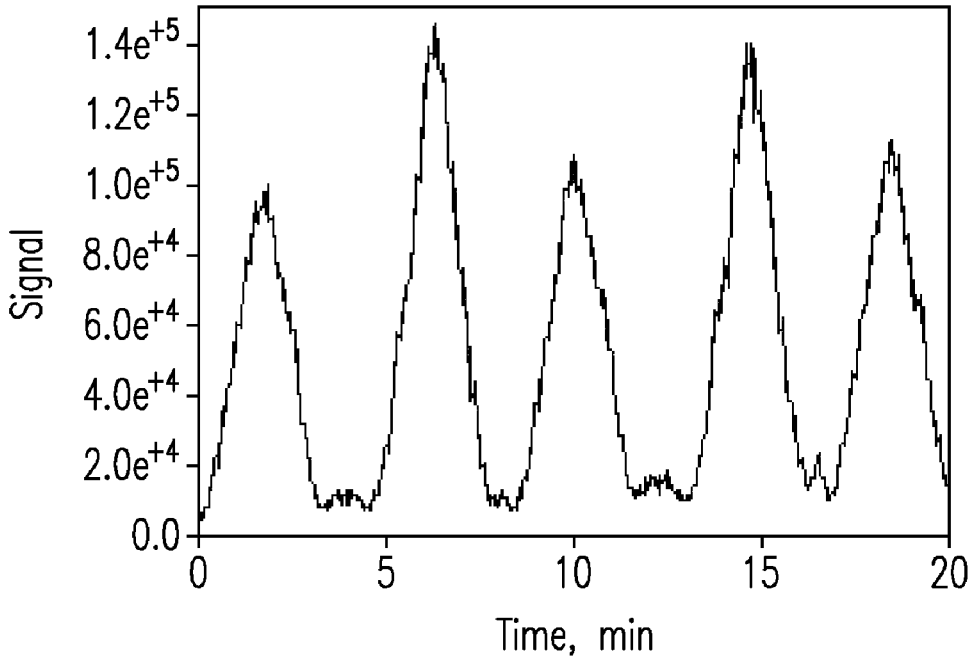
FIGS. 3*a*-3*b* show FAIMS and MS spectra for a tryptic digest of bovine serum albumin obtained in helium using an ion mobility microchip.
Figure 3B:
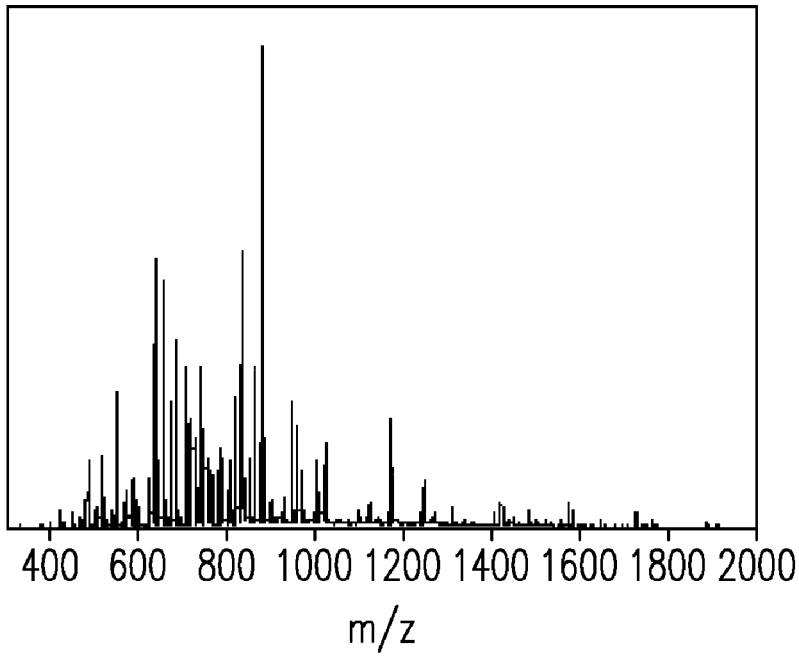

In terms of field intensity, the breakdown threshold for any gas increases in narrower gaps. In particular, by the Paschen law, gaps of g=35 μm can sustain A up to ~170 kV/cm, or ~170% of the value theoretically necessary for focusing at P=1 atm. Operation at ~80% of the breakdown voltage tends to be very stable, thus the factor of 1.7 provides headroom to increase A above the projected 100 kV/cm (if necessary) while ensuring system stability. Experimentally, electrode stacks with gaps of g=35 μm at ambient pressure easily support RF electric fields with w ~30 MHz and A of at least 60 kV/cm, or >50% above the maximum A for g=0.5 mm. Experiments detailed herein demonstrate that the above remains true in He; $N_2$ mixtures and He gas. For example, FIG. 3*a* and FIG. 3*b* shows the total FAIMS and MS spectra (respectively) obtained for the tryptic digest of bovine serum albumin in He using a microchip with g=35 μm, A ~60 kV/cm, and w=28.5 MHz. These data indicate that A ~100 kV/cm can be established in He/$N_2$ with high He content, if not pure He. Experimentally; the electrode stacks of the FANS microchip allow harmonics with w of at least 57 MHz, which exceeds what we estimate here as needed for focusing at P=1 atm, Thus, RF fields of a frequency and amplitude needed to operate the present invention can be maintained even in the He gas.

Chip-based devices in accordance with the invention, with microscopic gaps between electrodes, focus ions using the Dehmelt potential of a symmetric RF field. With g<100 μm and particularly ~75 μm, such devices can deliver RF fields of unprecedentedly high frequency and intensity that theoretically suffice for ion focusing at ambient pressure or near-ambient pressure, within the capability envelope of RF power supplies known in the art and without electrical breakdown in the gas. Formulation of this previously unrealized feasibility is central to the Invention.

The above linear scaling of P with w and A applies to still gas, when the flow drag on ions does not materially affect their dynamics in RF fields. That is the case with current funnel implementations inside and at the terminus of IMS drift tubes where the gas flow if any is uniform and slow, but not at API/MS interfaces where ions in a supersonic jet expanding from the MS inlet must be contained. Hence the Dehmelt potential in existing ion funnels counteracts not only the ion diffusion and Coulomb repulsion, but also the interfering gas drag. A funnel at ambient pressure would experience no such turbulent flow of incoming gas, but only a laminar flow (accelerating toward the exit) due to suction from the following low-pressure region that actually assists ion transmission. Hence atmospheric-pressure ion focusing may be enabled at lower and A values than those derived from scaling the parameters of known devices.

Solvated ions such as those generated by ESI require desolvation prior to or at the entrance into a funnel at any pressure. That can be achieved using radiated ion heating or a heated gas bath as employed, e.g., prior to introduction of ESI-generated ions into an ambient-pressure IMS or FAIMS devices.

Microelectrode arrays of desired patterns may be effectively stamped as a single piece on a silicon template and metalized on the surface, e.g., by chemical vapor deposition (CVD). The capacitors and resistors required to form and deploy the necessary RF/DC combinations can be microfabricated on the opposite surface and connected to the metalized strips using masks. Whereas prior ion funnels had curved (conical) internal surfaces, planar ion repelling surfaces are preferred herein given the ease and costs of microfabrication using standard semiconductor processes. Thus, in another key aspect of the invention, ions are confined or focused in one dimension at a time using V-shaped or "wedge" funnels described below. However, the invention is not limited thereto and no limitations are intended by the configurations exemplified herein.

Figure 4A:
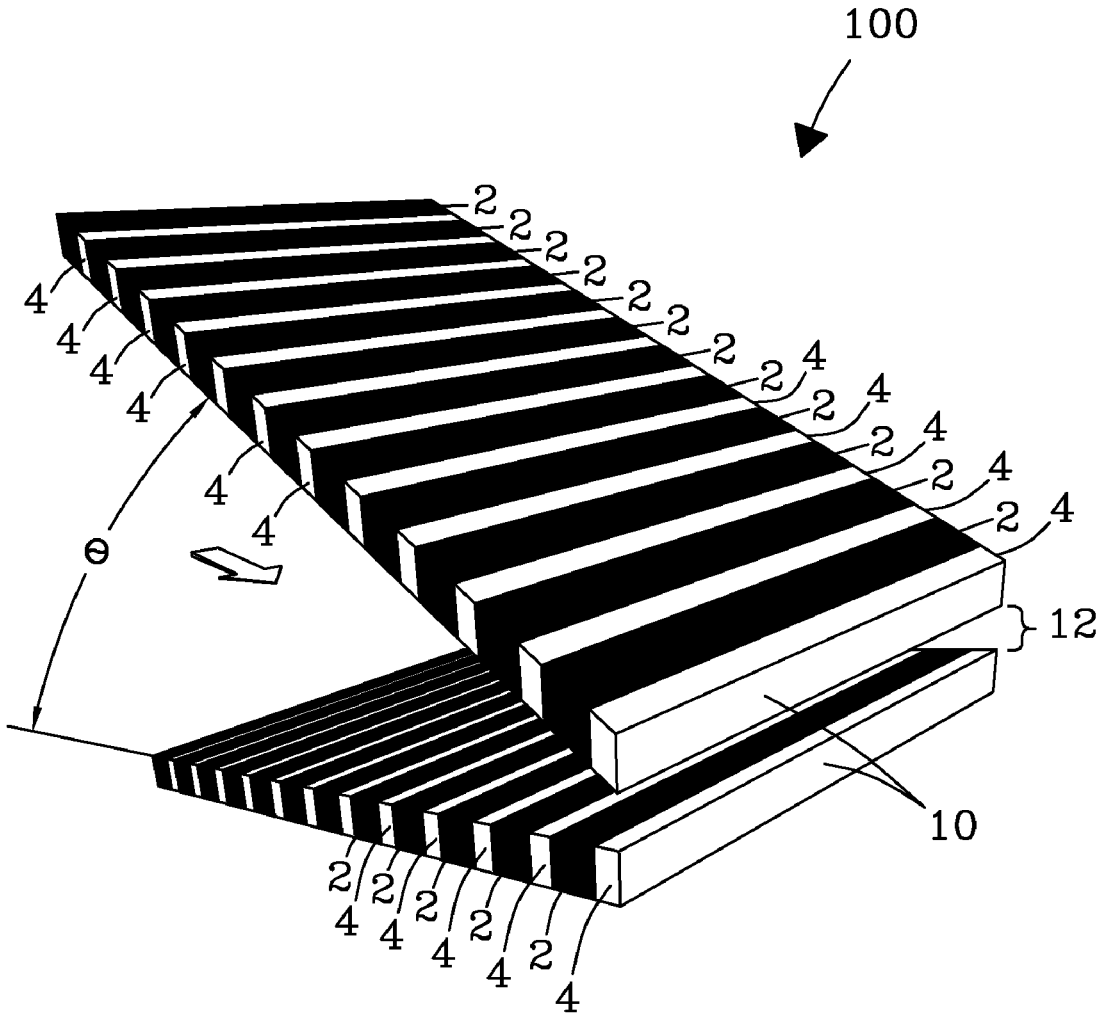
FIGS. 4*a*-4*c* show various wedge ion funnel configurations, according to different embodiments of the invention.
Figure 4B:
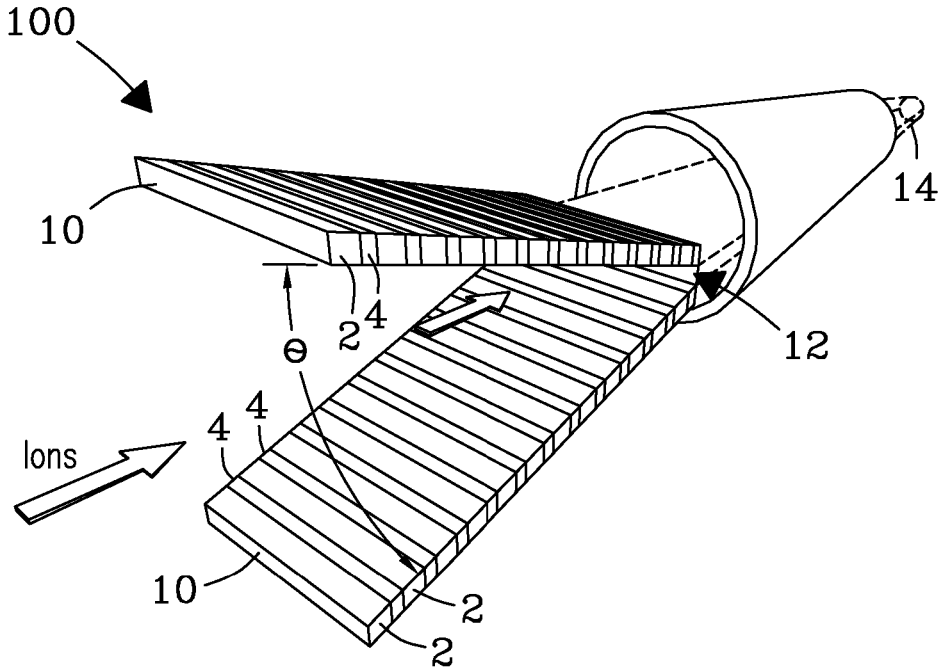
Figure 4C:
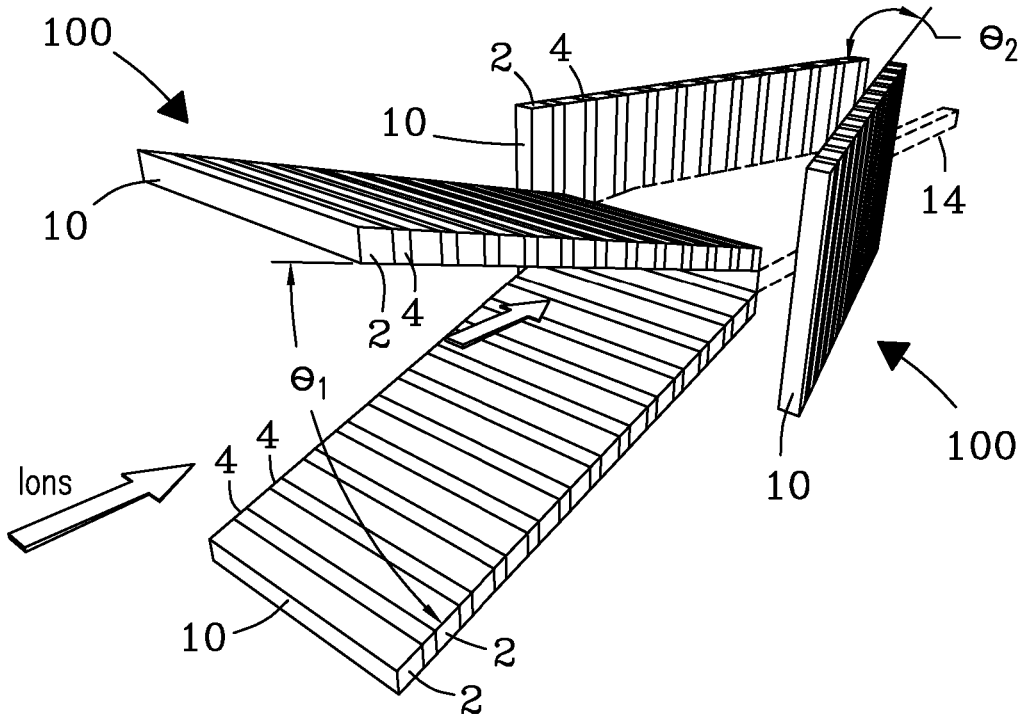

FIGS. 4*a*-4*c* show various wedge ion funnel configurations, according to different embodiments of the invention. FIG. 4*a* shows a longitudinal section and front view of a "wedge" ion funnel 100 comprising two planar sheets 10 disposed at a preselected wedge angle (θ), each configured with electrodes 2 and insulating gaps 4 between them. The value of θ can vary, preferably from 25° to 50°. A slit opening 12 is located at the tip of funnel 100. FIG. 4*b* shows a wedge funnel 100 of the invention followed by a conventional conical funnel that re-focuses ions into a circular beam. Slit 12 can be sufficiently narrow for a pressure of less than ~30 Torr in the following differentially pumped chamber, which is low enough for known conventional funnel(s). For example, a wedge funnel 100 with g=35 μm and standard 1:1 ratio of electrode 2 and insulating gap 4 widths has s=70 μm that allows an exit slit 12 of ~120-140 μm width (or 15 times smaller than the exit aperture diameter of funnels known in the art) without undue axial ion trapping. With a practical lateral span of 15 mm, the area of slit 12 would be 1.8-2.1 $mm^2$. This essentially equals the 1.7-2.6 $mm^2$ cross section of multi-inlet capillaries (with up to 19 bores) leading from ambient pressure into ion funnels known in the art, The pressure in those funnels is ~10-30 Torr (depending on the pumping arrangement), and the pressure behind a "wedge" funnel will be similar.

According to another embodiment of the invention, two wedge funnels 100 are placed consecutively as shown in FIG. 4*c*. Second funnel 100 is rotated 90° around the beam 14 axis relative to first funnel 100. The belt-shaped ion beam 14 leaving the first funnel 100 is refocused into a beam of square or near-circular cross section (cs) after passing the second funnel 100. The implementation of ion funnels, particularly those with microelectrodes, as planar-surface wedge devices, which can be manufactured using existing semiconductor technology and have a sufficiently narrow exit to maintain the pressure in following chamber(s) low enough for conventional funnel operation, is a second key aspect of the invention.

As stated above, the w and A values achievable in current funnels are limited by the power constraints of realistic RF waveform sources. To verify that a useful "wedge" funnel is operable using practical power supplies, one can compare its capacitance to that of known MEMS devices using similar RF waveform parameters, such as FAIMS microchips. The capacitance of a planar electrode stack is proportional to its total area and inverse gap width, however, as the exemplary funnel embodiment and the microchips have equal g values, one can simply compare the areas. In the version featuring 47 channels of 2.5 mm lateral span and 0.3 mm length, the gap area of the microchips is 35 $mm^2$. While the FAIMS electrode length depends on the ion residence time required for the desired separation quality, the funnel electrodes need to be deep enough for the RF field near the edges to stay unaffected by the underlying substrate. For that, the electrode depth should be at least about 2 g or 0.07 mm (with g=35 μm). That is much less than 0.3 mm, allowing a greater face area by 0.3/0.07=4.3 times, or 35 $mm^2$. With the lateral span of 15 mm, each side of the "wedge" can be 1.2 mm long. Many applications would be better suited by a funnel of smaller lateral span and proportionately greater length for same surface area, e.g., 5 mm and 3.6 mm, respectively. Such funnels can create a proportionately lower gas outflow, reducing the pressure and/or needed pumping capacity in the subsequent chamber(s).

Figure 5A:
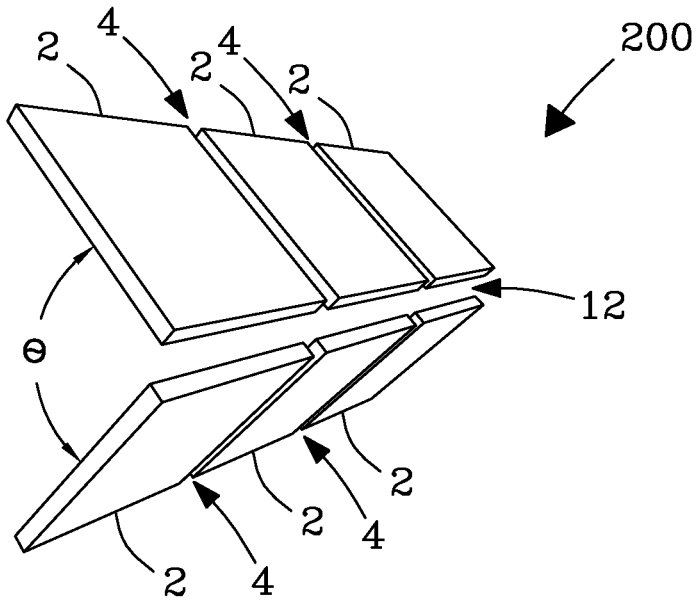
FIGS. 5*a*-5*c* show various composite ion funnel schemes, according to different embodiments of the invention.
Figure 5B:
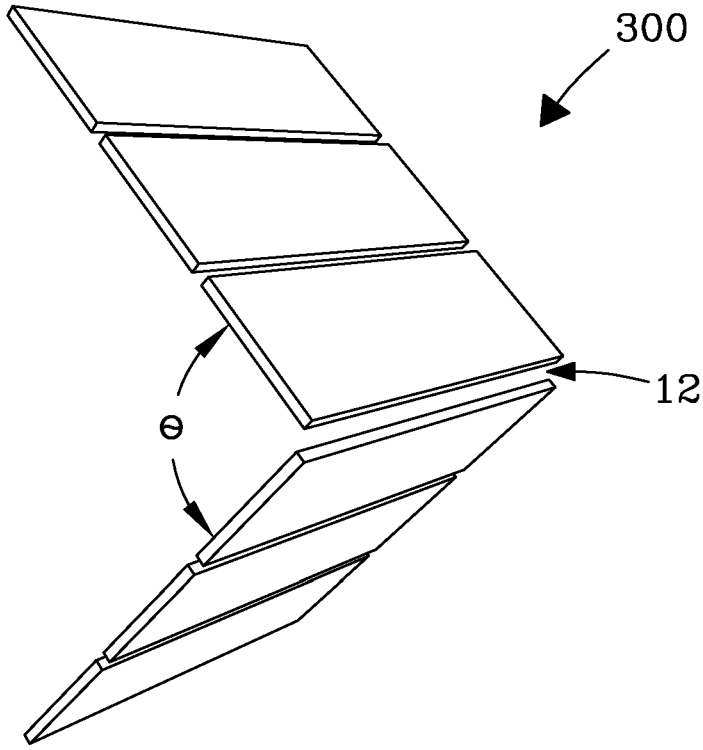
Figure 5C:
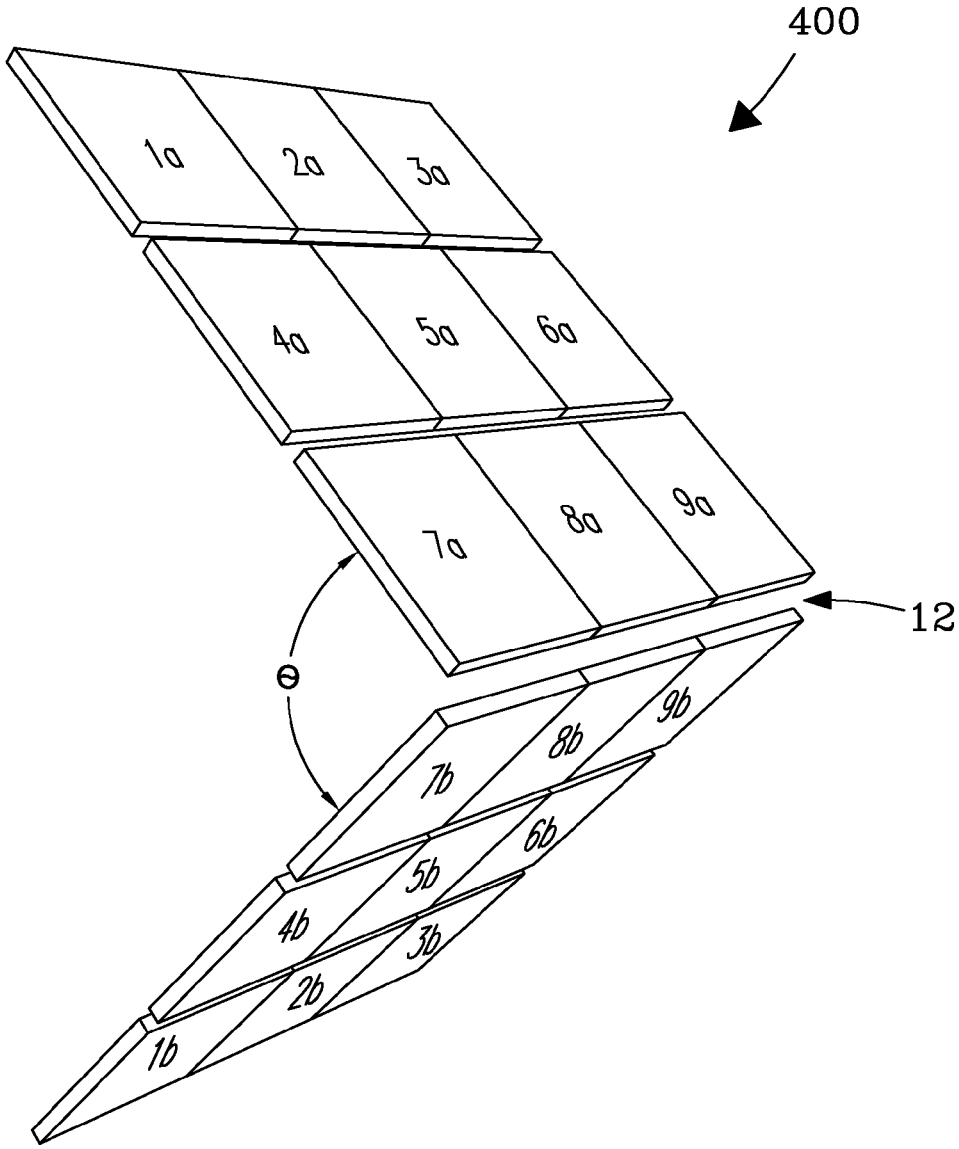

To capture and focus ion beams wider than the opening of a single funnel limited by capacitance constraints, multiple funnel panels can be assembled in various arrangements including, e.g., laterally, consecutively, or in a 2-D matrix. For example, FIGS. 5*a*-5*c* show composite wedge ion funnels of lateral 200, consecutive 300, and 2-D arrangements 400, respectively. A person of ordinary skill in the art will recognize that other arrangements can be made, thus no limitations are intended. In particular, five funnels can be laterally disposed such that the "wedge" sides have the span of 10 mm and length of 9 mm. With θ=45°, the composite funnel 200 would have a rectangular opening of 9 mm×8 mm. More powerful waveform supplies would allow larger composite funnels with fewer individual elements.

Ions driven through a gas by an electric field experience collisional or "field" heating that may induce their isomerization or dissociation. The magnitude of heating scales as $(KA)^2$, where K is the ion mobility. As K is proportional to 1/P and A should be scaled linearly with P for consistent ion funnel performance as discussed above, the quantity KA and thus the extent of ion heating in atmospheric-pressure funnels would equal that in existing funnels, despite much stronger fields. This heating may cause isomerization of fragile ions, such as proteins that have been observed to unfold in funnels known in the art. Hence ambient-pressure ion funnels, like the current low-pressure ones, may be unsuitable for handling of fragile ions when conformational characterization is intended (e.g., at the entrance to IMS drift tube). However, no dissociation of ions that would interfere with MS analyses has been observed in known funnels and none should occur in the atmospheric-pressure ones of the invention.

Figure 6:
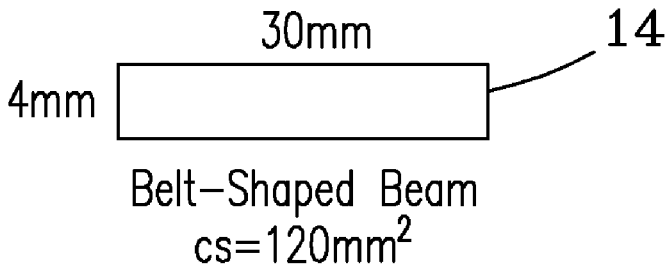
FIG. 6 shows exemplary ion beam shapes produced in accordance with different embodiments of the invention.
Figure 6:
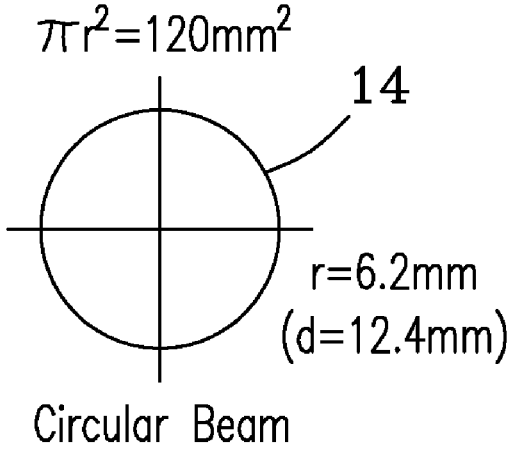
Figure 6:
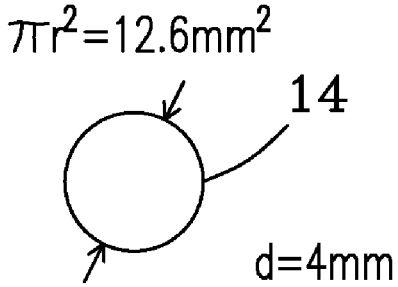

FIG. 6 compares circular ion beams 14 delivered by conventional funnels with belt-shaped beams 14 produced in accordance with different embodiments of the invention. In the figure, the belt-shaped beam 14 and circular 14 beam have the same cross-sectional areas (120 $mm^2$), but the circular beam 14 is over three times thicker than the belt-shaped beam 14 in the minimum dimension. Belt-shaped beams output by a wedge funnel may be focused into circular beams as discussed above. However, rectangular cross-sectional shapes are preferred in some arrangements because Coulomb repulsion scales as the ion density squared, and belt-shaped beams (focused in 1D) have a much smaller density than circular beams of the same minimum size focused in 2-D, e.g., by nearly tenfold compared to the circular beam 14 with the 4 mm diameter. While circular beams may have the same cross-sectional area and thus ion density as rectangular beams, they would be much thicker as exemplified above.

Figure 7:
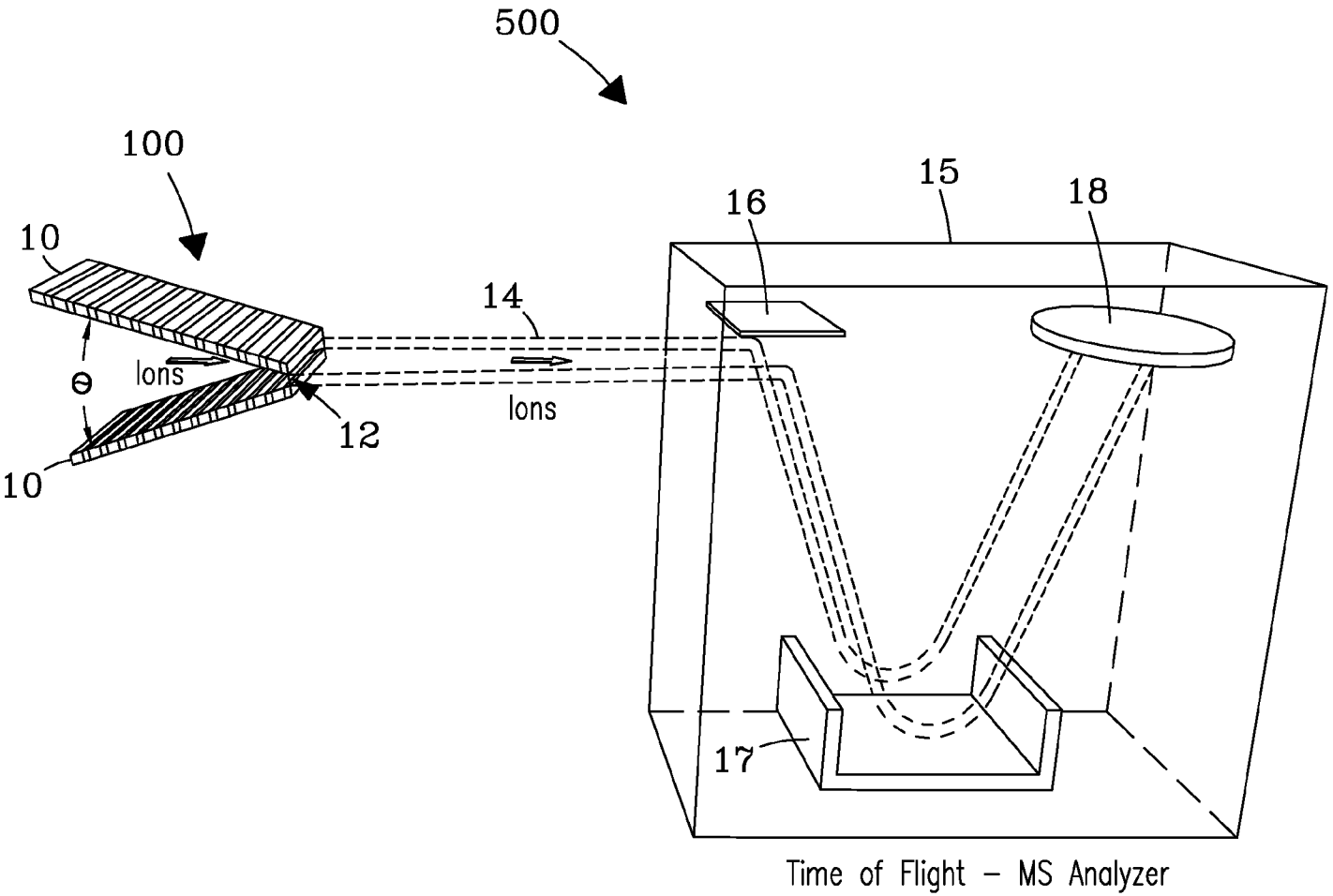
FIG. 7 shows beneficial use of a belt-shaped ion beam in the following time-of-flight MS analyzer, according to an embodiment of the invention.

FIG. 7 shows one system 500 for beneficial use of belt-shaped ion beams, according to an embodiment of the invention. In the figure, a belt-shaped beam 14, produced by wedge funnel 100 of the invention, is introduced into a o-ToF MS instrument 15. The thickness of incoming beam 14 defines the spread of initial ion coordinates along the flight path that limits the resolving power and decreases it for stronger ion currents. As space-charge phenomena depend on the total ion density, MS peaks for non-abundant species in a mixture also broaden when the total flux is large. Depending on the ion detection scheme, the recorded peak position and thus the mass measurement accuracy (mma) may be affected as well. Here, the losses of MS resolution and mma due to peak broadening are ameliorated by processing a rectangular beam 14 delivered by funnel 100 with the exit slit 12—and thus the beam plane—oriented parallel to the o-ToF pusher plate 16, ion mirror 17 (in a reflection ToF), and ion detector 18. In this "waterfall" configuration, the initial spread of ions perpendicular to pusher plate 16 is minimized, while their lateral spread parallel to pusher plate 16 does not affect the measured MS spectra.

Figure 8:
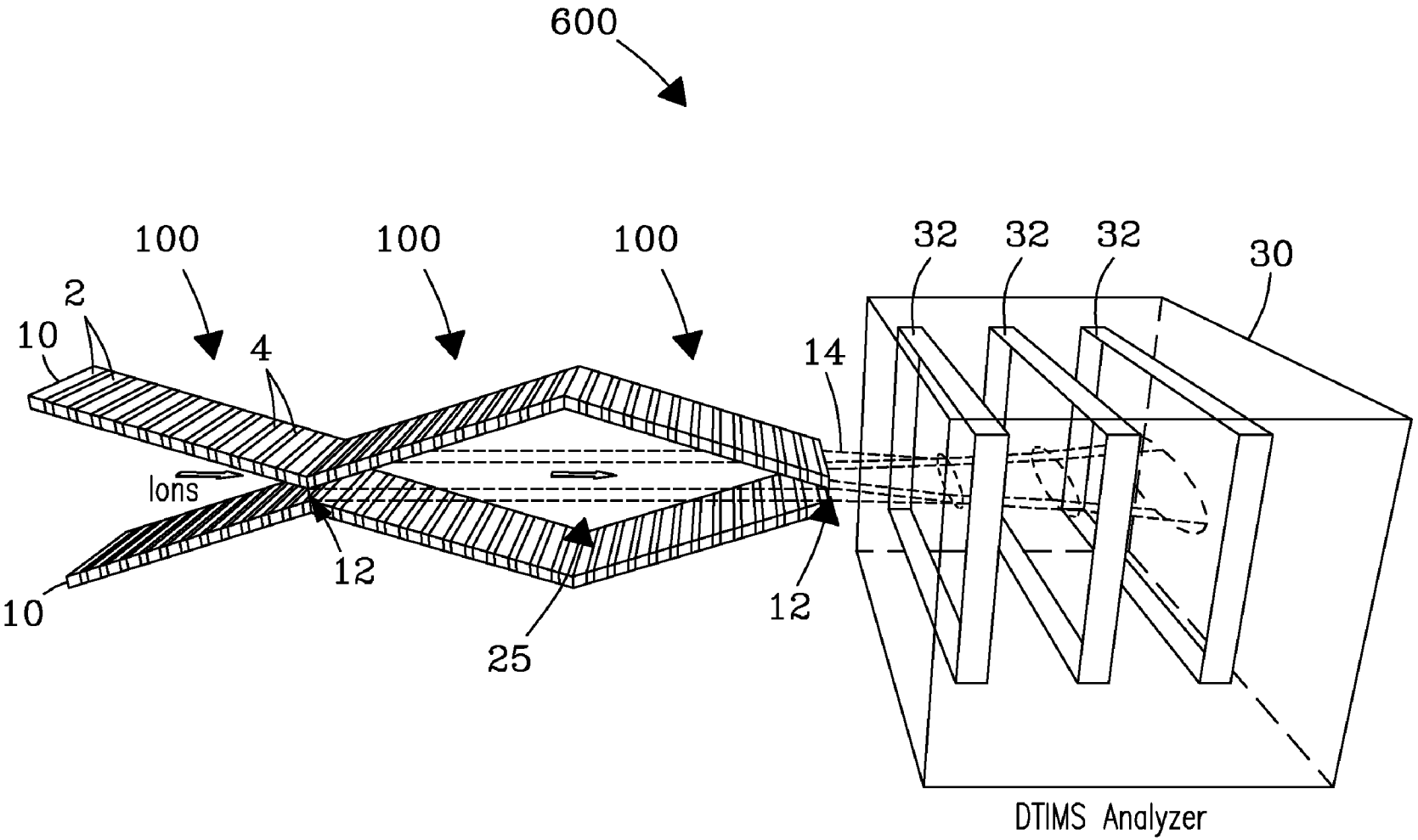
FIG. 8 shows beneficial use of a belt-shaped ion beam in the following drift-tube IMS analyzer, according to another embodiment of the invention.

The utility of belt-shaped ion beams is not limited to ToF MS. FIG. 8 shows another system 600 of the invention, in which a wedge funnel 100 introduces a rectangular beam 14 through a slit 12 into a wedge ion funnel trap (IFT) 25 defined by a second and a third wedge funnel 100 positioned as shown Cuboid packets delivered by IFT 25 are injected into an IMS drift tube 30 and mobility-separated therein while maintaining a laterally elongated shape. In this configuration, the electrodes 32 in tube 30 preferably have internal apertures with shape approaching that of beam 14 exiting IFT 25. As rectangular beams have a lower ion density, the Coulomb expansion that decreases the IMS resolving power is reduced, while lateral packet expansion does not affect the IMS resolution.

DTIMS/ToF MS is emerging as a powerful and versatile platform for complex mixture analyses, and various arrangements employing "wedge" funnels can be envisioned. One example is an embodiment where rectangular packets separated in DTIMS are refocused in 1D at the terminus by another "wedge" funnel and injected into the ToF MS. In this way, the whole IMS/MS analysis is performed on (chopped) belt-shaped ion beams. In another embodiment, a wedge funnel focuses spherical packets exiting the drift tubes known in the art into cuboid packets for ToF analyses. Openings of single "wedge" funnels (e.g., 15 mm×1.2 mm or 5 mm×3.6 mm) are smaller than the circles of 1-2 in. diameter in the funnels within or at the end of present IMS drift tubes. However, the ion beam expansion (through either diffusion or Coulomb repulsion) is much slower at higher and particularly ambient pressure. For example, a 15-cm long tube at atmospheric pressure that provides a resolving power of ~150, ions would spread to only ~1 mm width at half-maximum intensity, or ~2 mm near the peak baseline. This is within the 5×3.6 mm opening and well within the openings of larger funnel arrays exemplified above. Hence practical "wedge" funnels can be large enough to focus ions at IMS/MS interfaces and within IMS stages.

Planar rather than circular ion beams are also advantageous for analyses involving a tight beam of light (typically laser) or particles crossing the ion beam, such as in photoelectron spectroscopy (PES). In this scenario, the overlap of two beams and thus the ion utilization efficiency and sensitivity are maximized when the ion beam is no thicker than the laser (particle) beam. Circular ion beams are often much thicker, especially at higher flux because of Coulomb repulsion, whereas a belt-shaped beam of much lower ion density can remain thin for a long time as explained above. In another embodiment, a laser beam crosses a coplanar belt-shaped ion beam produced by a wedge funnel or a train of laterally elongated cuboid packets generated by a wedge IFT. This configuration would benefit various spectroscopies using laser or synchrotron beams (including optical, IR, PES, photodissociation, and X-ray imaging techniques). Some IMS/MS instruments feature a PES or other spectroscopic capability in the MS stage for more specific characterization of IMS-separated ions, and ion funnels known in the art have been employed at both IMS termini n these systems and are crucial for their practicality from the sensitivity viewpoint, Wedge ion funnels and IFTs can be used in these platforms to focus spherical ion packets separated by DTIMS into elongated cuboid packets for improved spectroscopic and MS analyses or to perform the whole IMS/spectroscopy/MS sequence on (chopped) belt-shaped ion beams.

Figure 9A:
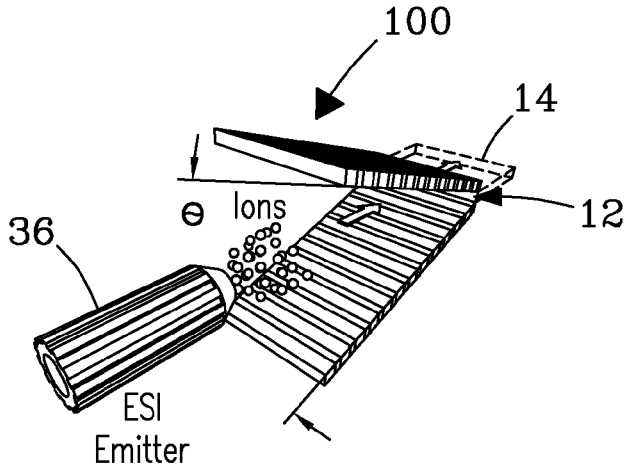
FIGS. 9*a*-9*c* show a "wedge" ion funnel interfaced after different ion sources, according to various embodiments of the invention.
Figure 9B:
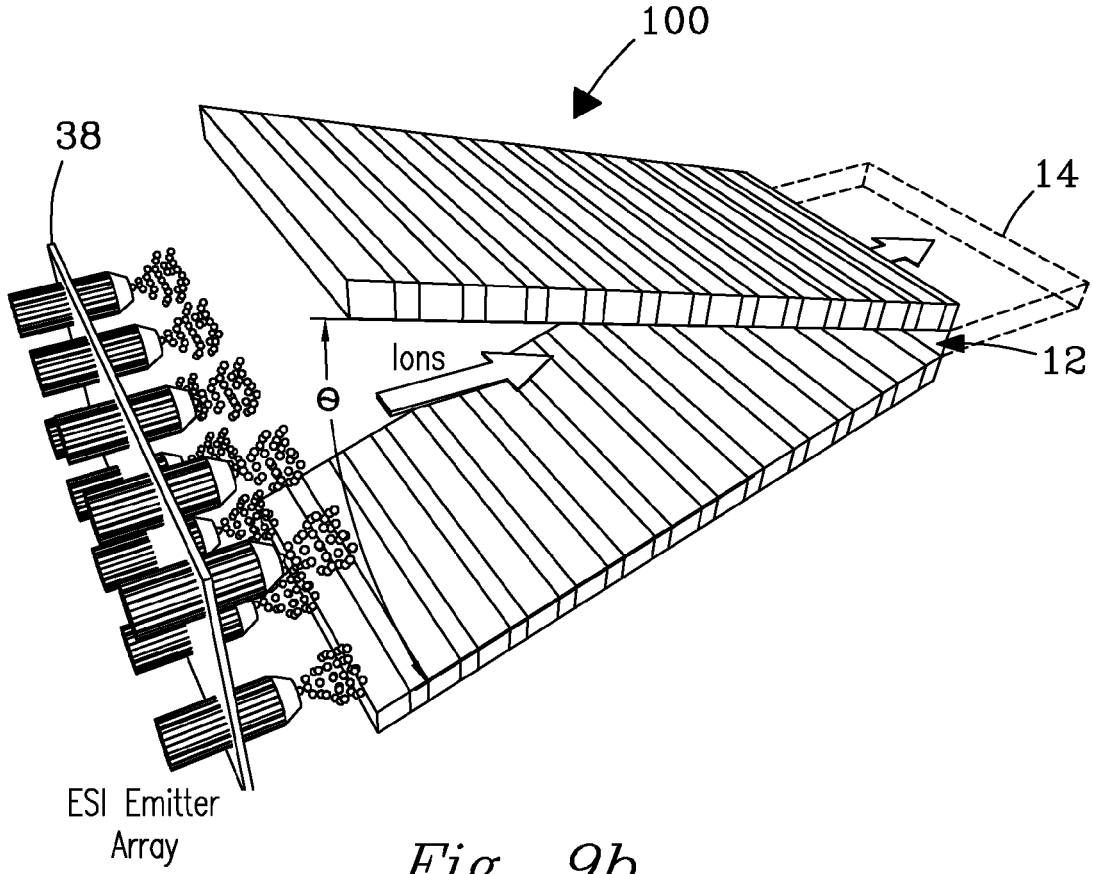

Like existing ion funnels, wedge funnels of the invention may receive ions from various sources. For example, FIG. 9*a* shows a wedge funnel 100 receiving ions from a single ESI emitter 36. FIG. 9*b* shows a wedge funnel 100 interfaced with an ESI multi-emitter array 38, in particular a linear or rectangular one that matches the shape of the opening 12 of funnel 100. With emitters in those arrays commonly spaced apart by ~0.5-1 Mm, the exemplary single funnel with 5 mm span allows ~5-10 emitters per row. Rectangular 2-D arrays can allow more emitters, e.g., ~20-80 with 4-8 rows covering the 5×4 mm opening of the exemplary funnel above. Funnel arrays with larger openings allow larger emitter arrays comprising a greater number of emitters.

Figure 9C:
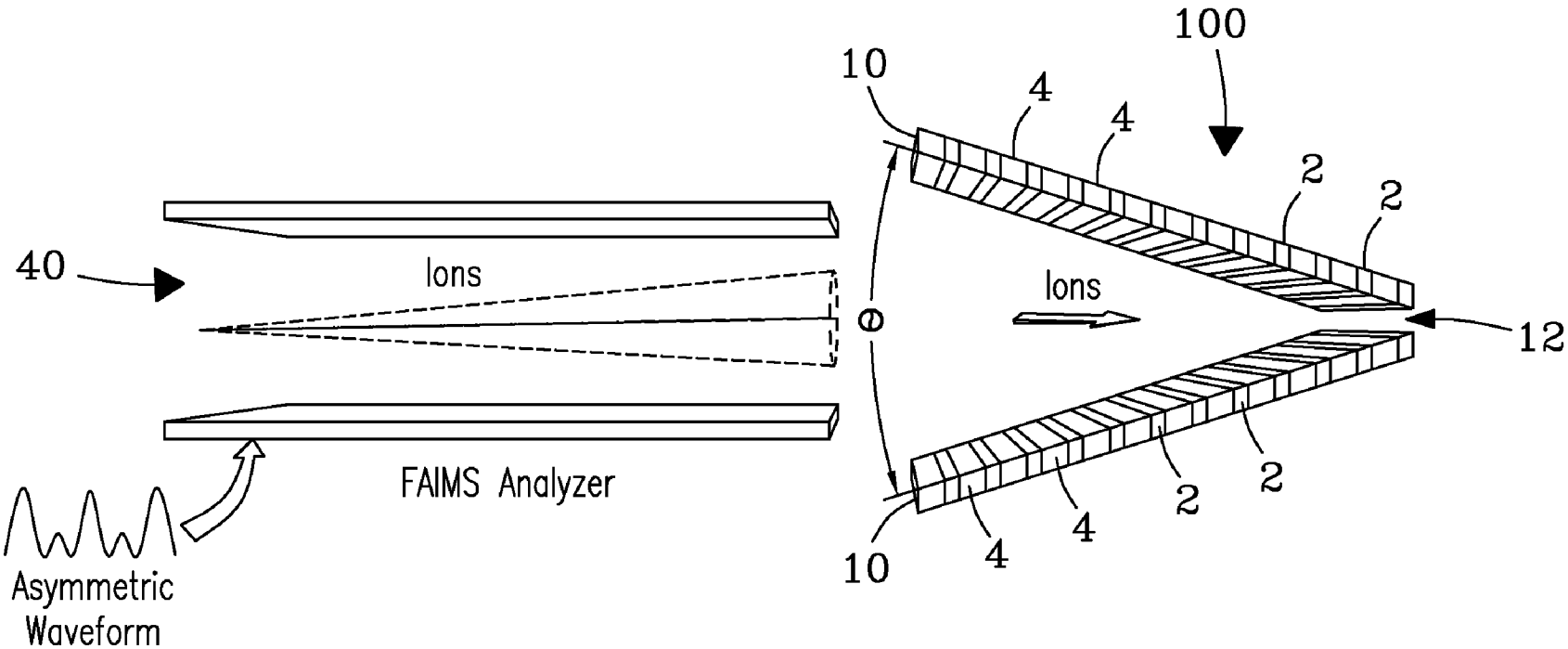

FIG. 9*c* shows a wedge funnel 100 of the invention following a planar FAIMS unit 40. As seen here, the funnel 100 may be especially useful to collect ions exiting planar or transverse-cylindrical FAIMS filters that inherently output rectangular beams. In this configuration, the exemplary funnel 100 has a linear span of 15 mm that exceeds the maximum lateral expansion of ion beams over reasonable timescales in existing FAIMS devices, while its 1.2 mm width approximately matches the thickness of those beams emerging from the typical 2 mm gap of these devices.

Figure 10:
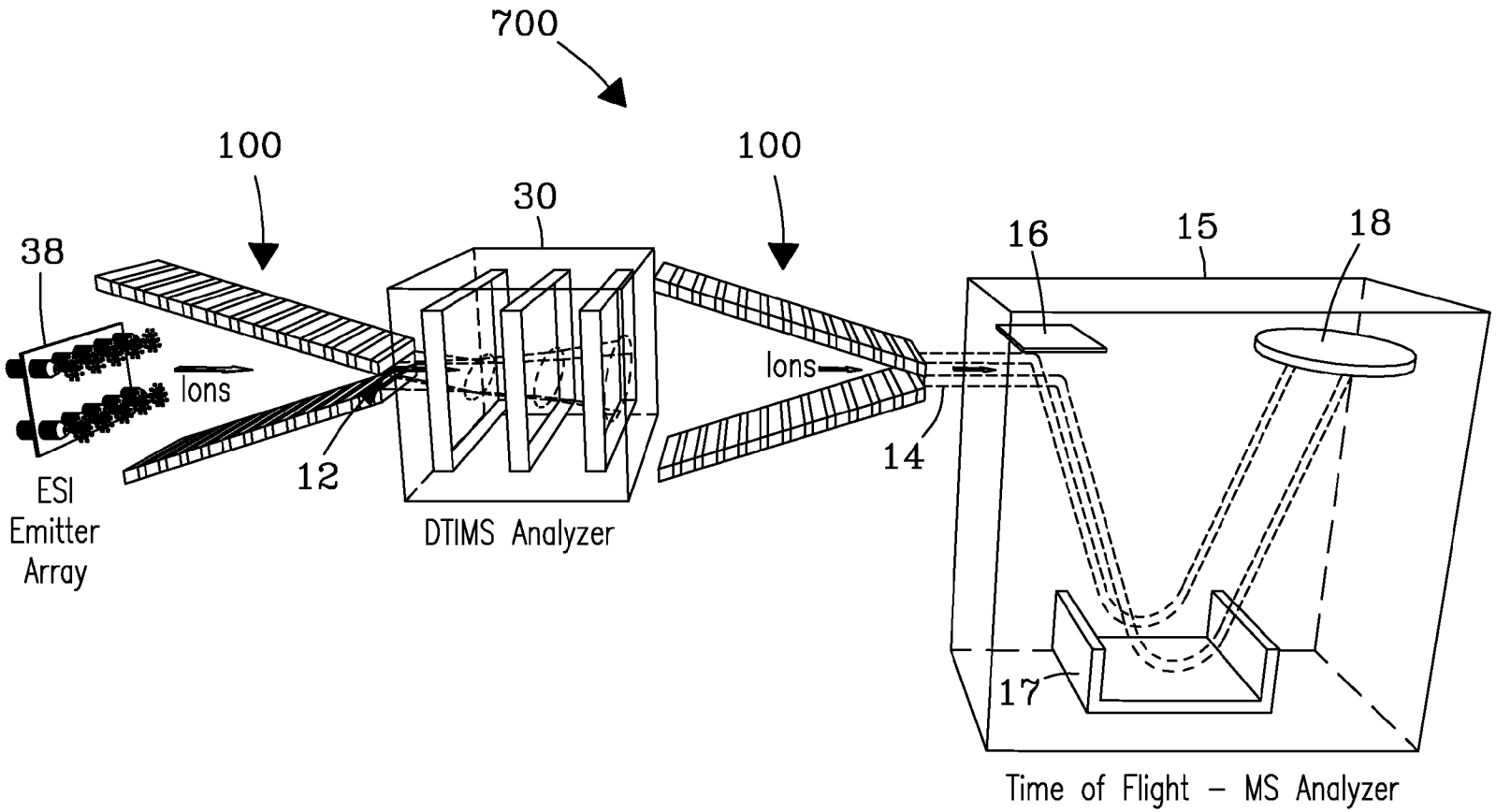
FIG. 10 shows a system comprising "wedge" ion funnels that enables complete "cradle-to-grave" in-plane ion analysis, according to an embodiment of the invention.

FIG. 10 shows a system 700 comprising a wedge ion funnel 100, which enables complete "cradle-to-grave" in-plane ion analysis, according to an embodiment of the invention. In the figure, an ESI multi-emitter array 38 delivers ions to the (first) funnel 100. The rectangular ion beam 14 exiting the rectangular slit 12 is delivered to a DTIMS analyzer 30 described above. Cuboid ion packets are then delivered through another (second) wedge funnel 100 into a ToFMS 15 for ion detection and analysis. System 700 is exemplary of similar systems including, but not limited to, e.g., ESI/IMS/ToF, ESI/FAIMS/ToF, or ESI/FAIMS/IMS/ToF, where wedge funnels can provide in-plane beam processing over the entire analysis path, including a spectroscopy step in the ToF stage if desired. The utility of wedge funnels for producing ion beams of rectangular cross section that are thin to minimize the coordinate spread in one direction and wide to maximize the overlap with light or particle beams in the perpendicular direction, can make those funnels attractive even at lower gas pressures, where known conical funnels focus ions effectively. Wedge funnels operating at lower pressure can have macroscopic gap widths, differing from present circular funnels only in the (elongated rectangular) aperture shape, However, the wedge funnels with microscopic gaps can have proportionally narrower exit slits, providing much tighter beam focusing without causing unacceptable ion trapping. Realization that (i) conventional (drift tube or traveling-wave) MS, FANS, ToF MS, other MS analyzers, laser or synchrotron spectrometry systems, and various combinations thereof may benefit from the use of belt-shaped beams and that (ii) wedge ion funnels can effectively deliver such beams is a third key facet of the present invention.

While a number of embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A device for spatial confinement, guidance, or focusing of ions in gases, comprising:

a plurality of electrode elements having microscopic gaps therebetween that produce a Dehmelt pseudopotential due to an oscillatory electric field created by an alternating voltage applied to said elements, wherein field intensity required for effective confinement or focusing under the operational gas pressure is precluded by electrical breakdown through the gas in macroscopic gaps but permitted in microscopic gaps having a higher breakdown threshold.

2. The device of claim 1, wherein said gas pressure is the ambient atmospheric pressure; or a pressure ranging from 50 Torr to about 1 atm; or a pressure ranging from about 1 atm to 5 atm.

3. The device of claim 1, wherein said microscopic gaps range in width from 10 μm to 200 μm; or from 20 μm to 100 μm.

4. The device of claim 1, wherein said electrode elements have microscopic thicknesses that range from 10 μm to 200 μm; or that range from 20 μm to 100 μm.

5. The device of claim 4, wherein the electrode elements have microscopic thicknesses that range from ⅓ times to 3 times the width of gaps between the electrode elements; or the thicknesses are equal to the width of the gaps between the electrode elements.

6. The device of claim 1, wherein the frequency of said oscillatory field ranges from 10 MHz to 150 MHz; or from 25 MHz to 60 MHz.

7. The device of claim 1, wherein the electrode elements are plates having internal apertures of any geometry arranged in a stack that conveys ions through said apertures sequentially across the stack while repelling ions inside from the aperture circumference by the Dehmelt pseudoforce.

8. The device of claim 7, wherein neighboring plates carry opposite phases of an alternating voltage.

9. The device of claim 8, wherein ions are propelled along the stack by a time-independent longitudinal electric field derived from a ladder of fixed voltages applied to said plates in superposition with the alternating voltage.

10. The device of claim 7, wherein ions are propelled along the stack by a gas flow resulting from vacuum suction into a following instrument stage maintained at a lower gas pressure selected from: a mass spectrometer, an ion mobility spectrometer, a photoelectron spectrometer, a photodissociation spectrometer, and combinations thereof.

11. The device of claim 7, wherein said apertures have essentially the same geometry and cross-sectional area, defining an ion-guiding tunnel.

12. The device of claim 7, wherein said apertures have homologous shapes and cross-sectional areas that decrease along the stack, defining a funnel that focuses ion beams entering the stack through an entrance aperture into tighter beams exiting through a smaller terminal aperture.

13. The device of claim 7, wherein said apertures have homologous shapes and cross-sectional areas that increase in preselected segments and decrease in other preselected segments along the stack, defining an hourglass ion funnel or a double hourglass ion funnel, wherein regions of said funnels having wider apertures for ion storage are spaced between, or separated by, regions of narrower apertures that provide ion focusing.

14. The device of claim 1, wherein the electrode elements are built on, or attached to, a preselected surface forming a periodic grating, such that the Dehmelt pseudoforce repels ions from said preselected surface.

15. The device of claim 14, wherein the preselected surface of the electrode elements is composed of a metal or other electrically-conductive material disposed on an insulating substrate forming the body of the electrode elements.

16. The device of claim 14, wherein ions are further moved along said preselected surface by a longitudinal electric field derived from a ladder of fixed voltages applied to the electrode elements in superposition with alternating voltages.

17. The device of claim 14, wherein at least two of said surfaces are disposed at an angle, forming a wedge with an open slit at the apex thereof which compresses a beam of ions entering an open base of the wedge in one dimension, forming a narrower belt-shaped beam exiting through said slit.

18. The device of claim 17, wherein ions are propelled through said wedge toward the exit by: a longitudinal electric field derived from a ladder of fixed voltages applied to the elements on said surfaces in superposition with alternating voltages, a gas flow resulting from vacuum suction into a following instrument stage, or a combination thereof.

19. The device of claim 18, wherein said following stage is selected from the group consisting of: a mass spectrometer, an ion mobility spectrometer, a photoelectron spectrometer, a photodissociation spectrometer, and combinations thereof.

20. The device of claim 17, wherein said device is disposed to receive ions from a linear or elongated rectangular array of elementary sources selected from: an electrospray (ESI) emitter array, or a plate for matrix-assisted laser desorption ionization (MALDI).

21. The device of claim 17, wherein said device is disposed at or after the terminus of an ion mobility spectrometry (IMS) analyzer to compress ion packets exiting therefrom into a parallelepiped geometry for injection into another instrument stage.

22. The device of claim 17, wherein said device is disposed at or after the terminus of a differential mobility analyzer (DMA), a differential mobility spectrometry (DMS), or a field asymmetric waveform ion mobility spectrometry (FAIMS) analyzer having a planar or transverse-cylindrical gap geometry to compress the belt-shaped ion beam exiting therefrom for injection into another instrument stage.

23. The device of claim 17, wherein said belt-shaped ion beam is refocused into a circular or a different cross-sectional shape using a following electrodynamic ion funnel with a gas pressure lower than that inside said wedge.

24. The device of claim 17, wherein said belt-shaped ion beam is introduced into a subsequent ion mobility spectrometry (IMS) stage in a continuous or pulsed mode, and separated or filtered therein while retaining a rectangular cross section.

25. The device of claim 24, wherein said IMS stage operates in a mode selected from the group consisting of: drift-tube IMS, traveling-wave IMS, DMA, DMS, FAIMS, and combinations thereof.

26. The device of claim 24, wherein said device receives ions from a source of linear or elongated-rectangular shape.

27. The device of claim 24, wherein said belt-shaped beam is further extracted from said IMS stage with compression that retains its rectangular cross section with another device selected from the group consisting of: ion mobility spectrometers, photoelectron spectrometers, photodissociation spectrometers, and combinations thereof.

28. The device of claim 17, wherein said belt-shaped beam is injected into a subsequent mass spectrometry (MS) stage, in a continuous or pulsed mode, and analyzed therein while retaining a rectangular cross section.

29. The device of claim 28, wherein said MS stage is a time-of-flight (ToF) mass spectrometer, and the lateral span of said belt-shaped beam is orthogonal to both the directions of ion velocity in MS analysis and ion injection into the ToF instrument.

30. The device of claim 28, wherein said device receives ions from a source of linear or elongated-rectangular shape.

31. The device of claim 30, wherein said belt-shaped beam is further injected into a subsequent mass spectrometry (MS) stage and analyzed therein while retaining the rectangular cross section such that the whole IMS/MS separation is performed on a planar ion be.

32. The device of claim 31, wherein said MS stage is a time-of-flight (ToF) mass spectrometer, and the lateral span of said belt-shaped beam is orthogonal to both the ion velocity vector in MS analysis and the direction of ion injection into the ToF instrument.

* * * * *